US007640757B2

(12) United States Patent
Lee

(10) Patent No.: US 7,640,757 B2
(45) Date of Patent: Jan. 5, 2010

(54) AIR CONDITIONER HAVING AN ENHANCED USER PERCEPTION

(75) Inventor: Choong Hee Lee, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 10/957,668

(22) Filed: Oct. 5, 2004

(65) Prior Publication Data

US 2005/0109048 A1 May 26, 2005

(30) Foreign Application Priority Data

Nov. 24, 2003 (KR) ..... 10-2003-0083541

(51) Int. Cl.
*G01K 13/00* (2006.01)

(52) U.S. Cl. ..... 62/129; 62/127; 62/262; 62/426; 236/64; 165/120; 165/122; 165/124

(58) Field of Classification Search ..... 62/126, 62/127, 129, 262, 426; 236/64; 165/120, 165/122, 124
See application file for complete search history.

(56) References Cited

U.S. PATENT DOCUMENTS 5,453,939 A * 9/1995 Hoffman et al. ..... 702/183
6,073,455 A * 6/2000 Tachigori et al. ..... 62/129
6,243,645 B1 * 6/2001 Moteki et al. ..... 701/211
6,493,001 B1 12/2002 Takagi et al.
2002/0109719 A1 * 8/2002 Hata et al. ..... 345/748
2002/0189274 A1 * 12/2002 Lee et al. ..... 62/298
2003/1007267 * 4/2003 Takeda et al. ..... 422/22
2005/0092015 A1 * 5/2005 Park et al. ..... 62/419

FOREIGN PATENT DOCUMENTS

JP 59-079746 5/1984
JP 2000076487 3/2000
JP 2001272089 A 10/2001
JP 2002-11275 A 1/2002
JP 2003-088326 3/2003
JP 2003248841 9/2003

* cited by examiner

*Primary Examiner*—Frantz F Jules
*Assistant Examiner*—Azim Rahim
(74) *Attorney, Agent, or Firm*—Birch, Stewart, Kolasch & Birch, LLP

(57) ABSTRACT

An air conditioner having an enhanced user perception and a controlling method thereof are provided. A predetermined character and/or its applied character image are/is displayed on a display window of the air conditioner. The character and/or the character image are/is changed depending on the operational states of the air conditioner, so that the user perceives the operational state of the air conditioner more conveniently. The air conditioner has advantages in that the user can perceive the operational state of the air conditioner more conveniently, the user can be stimulated to purchase the product, and a use term of the air conditioner can be extended.

23 Claims, 21 Drawing Sheets

【Fig. 8】
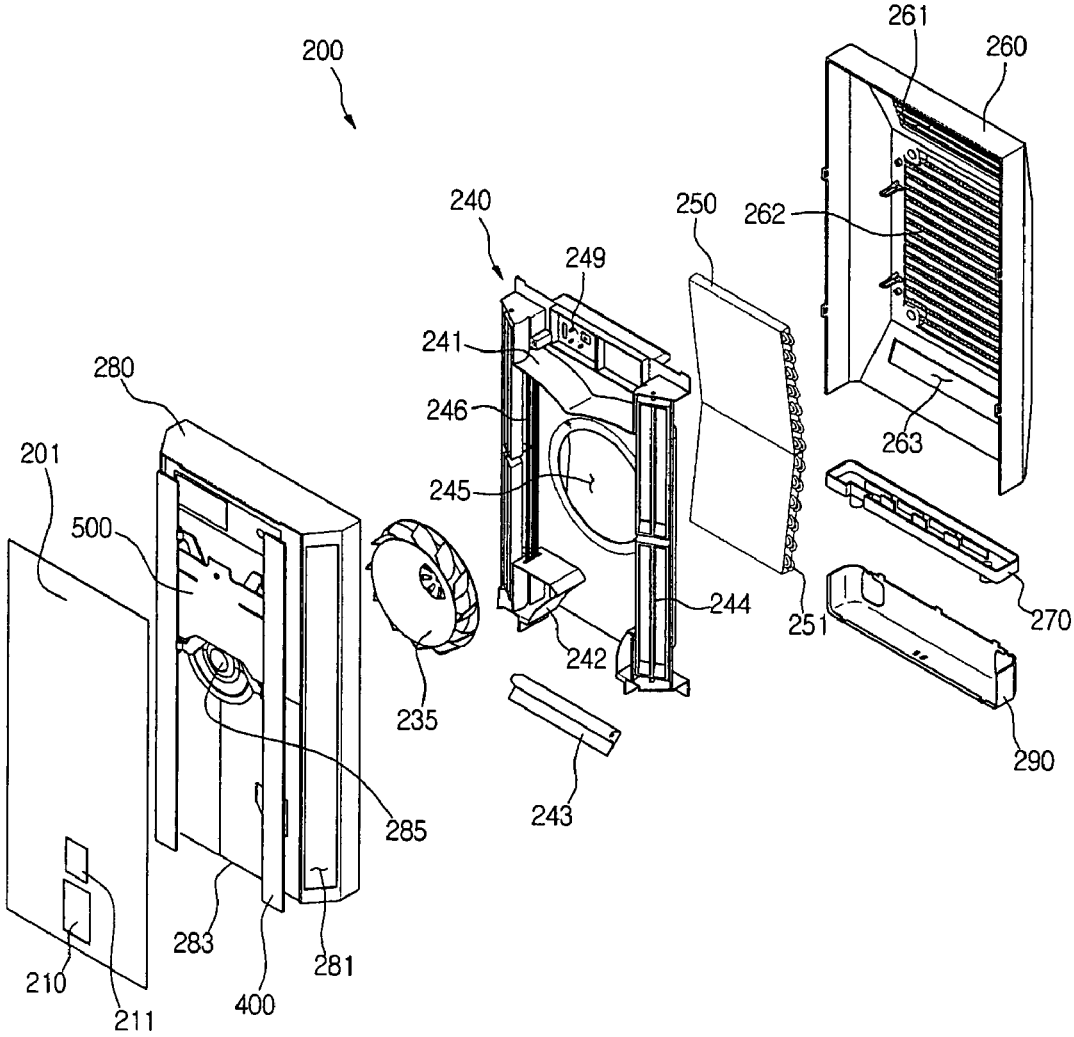

【Fig. 9】
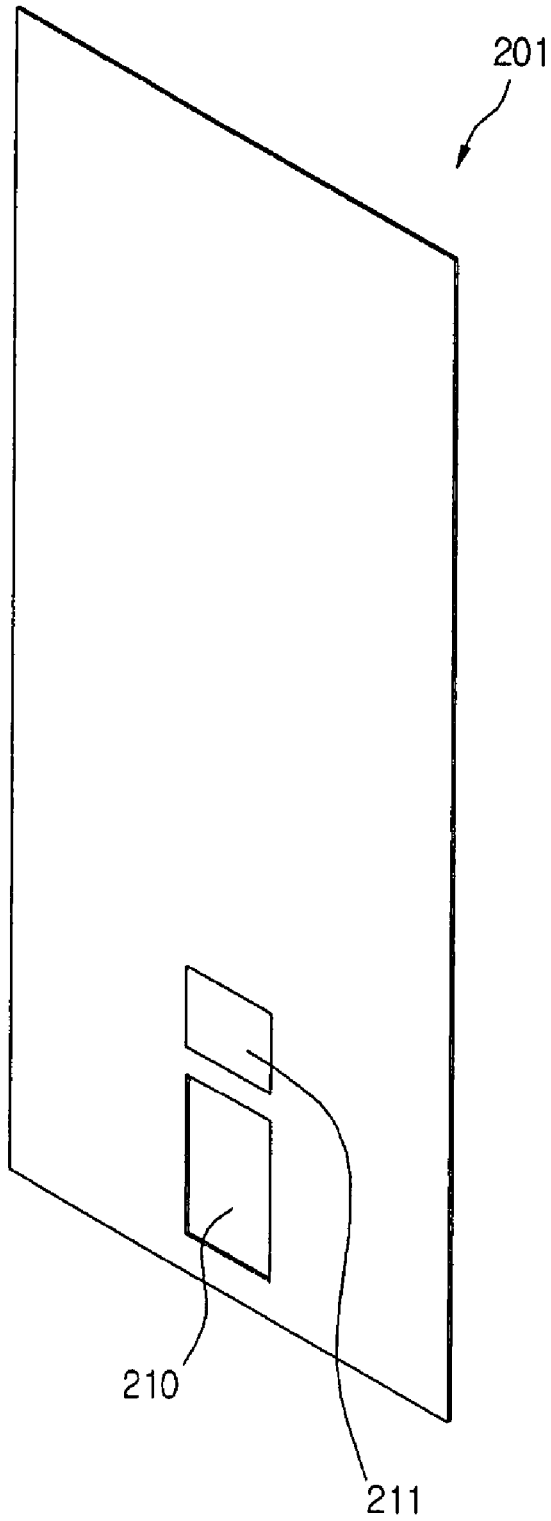

【Fig. 10】
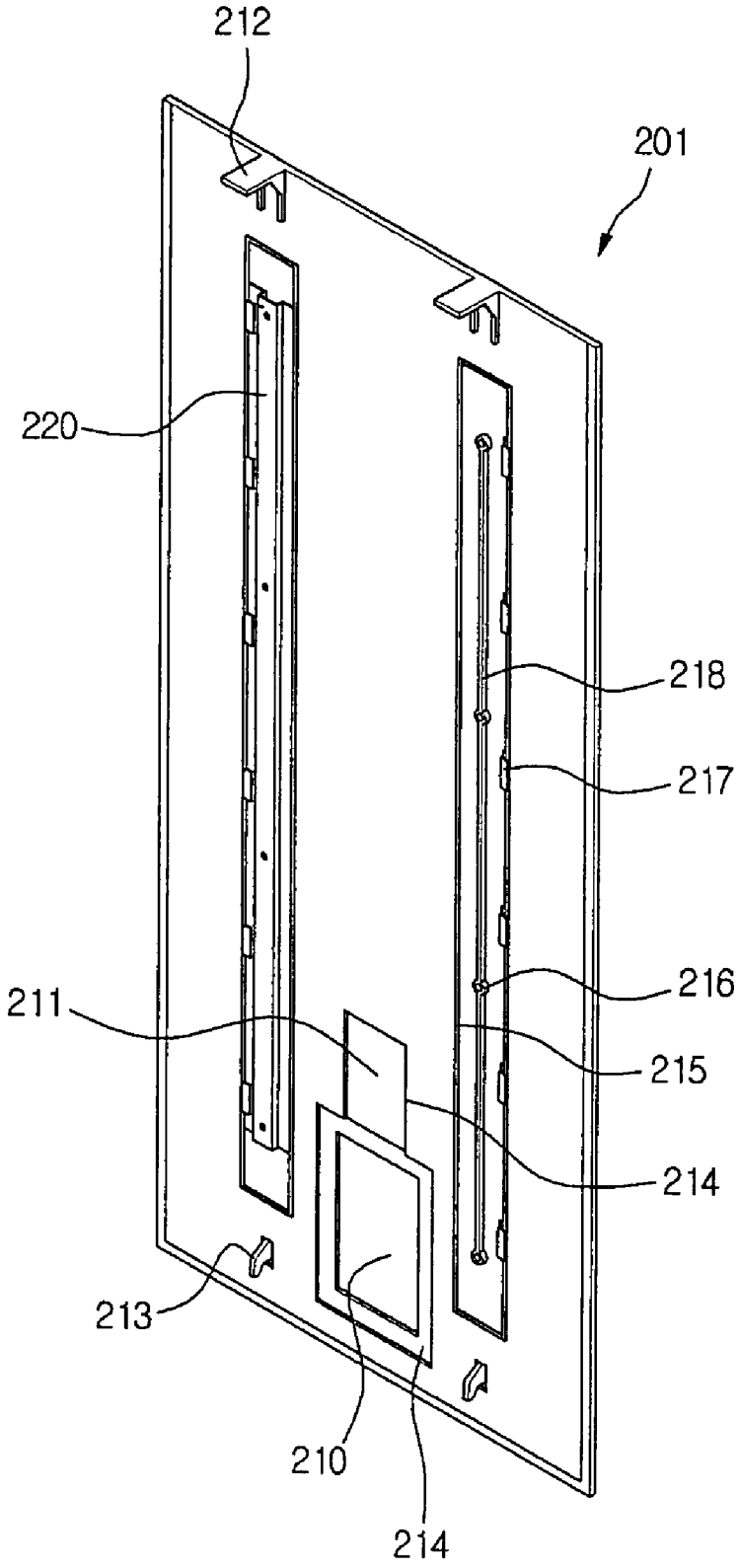

【Fig. 11】
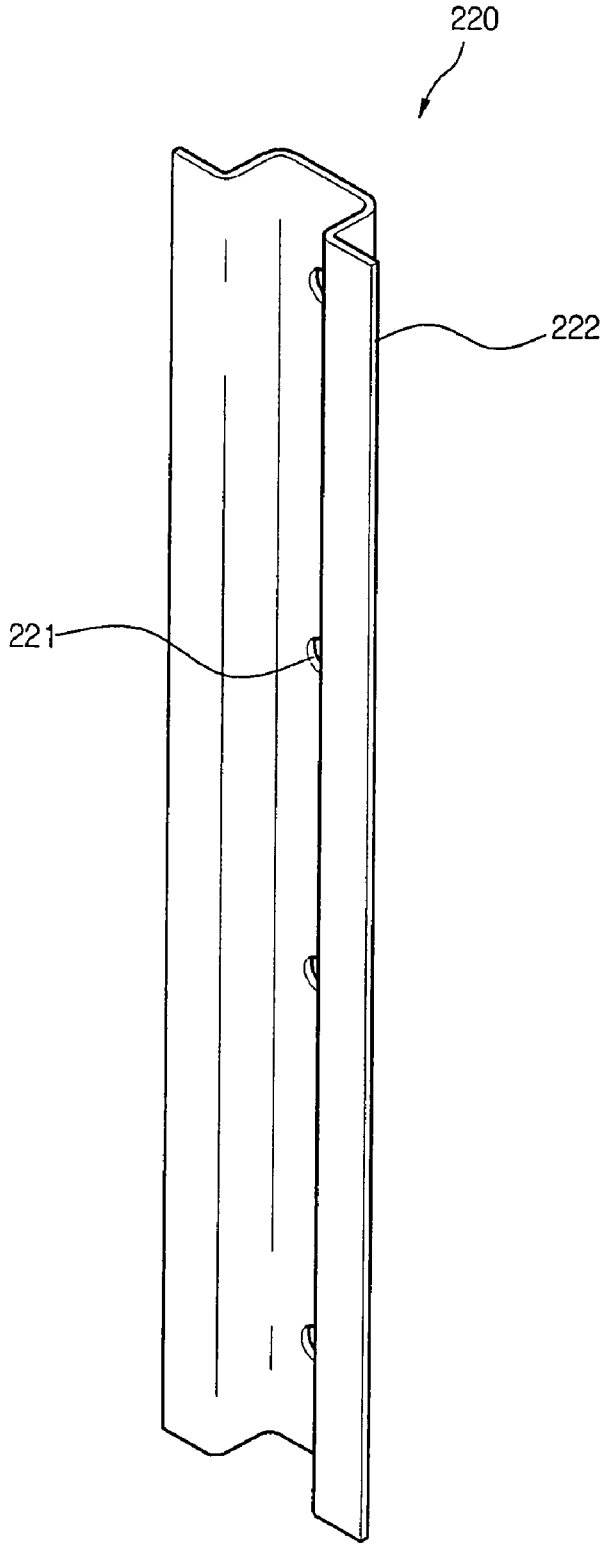

【Fig. 12】
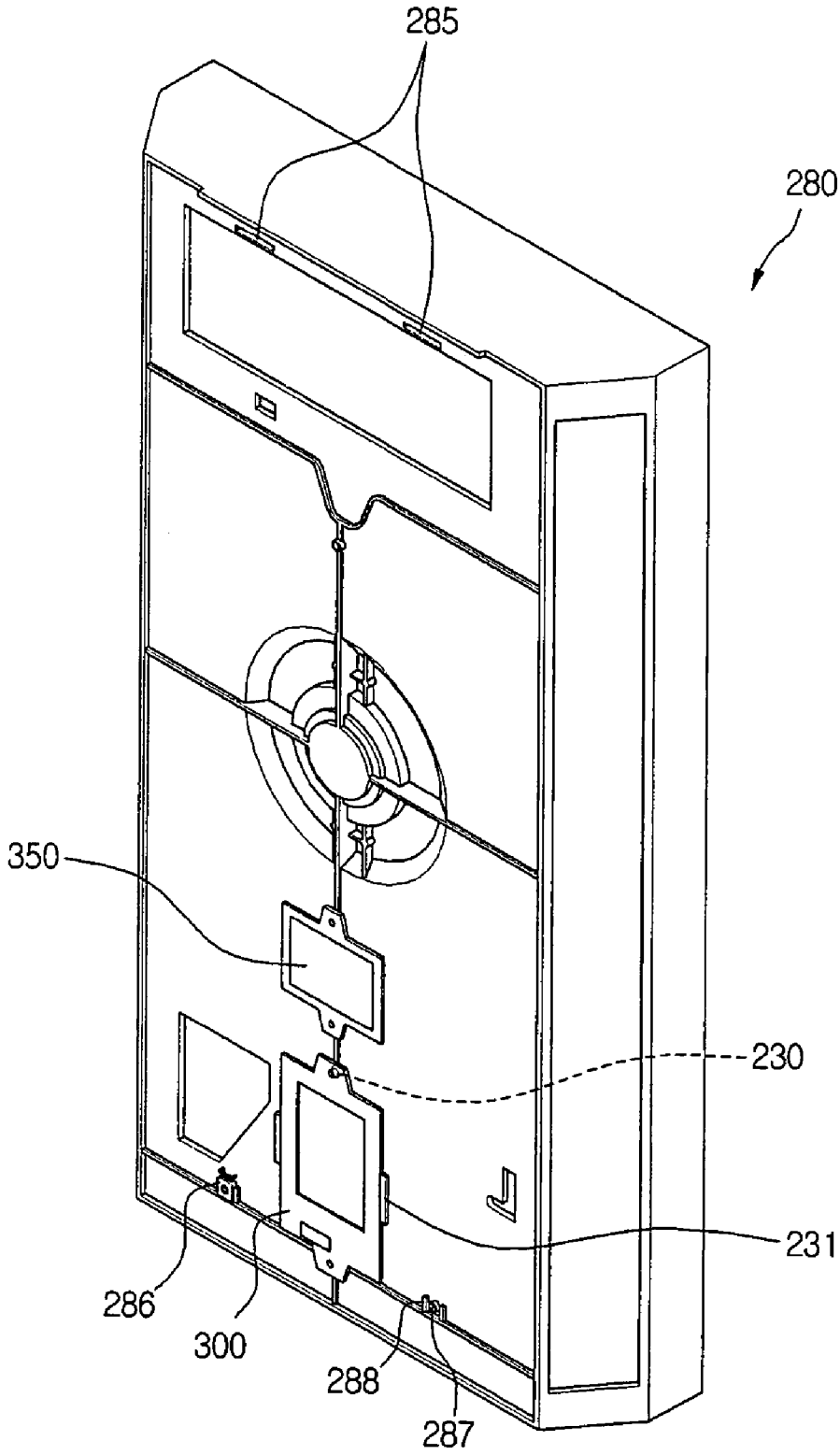

【Fig. 13】
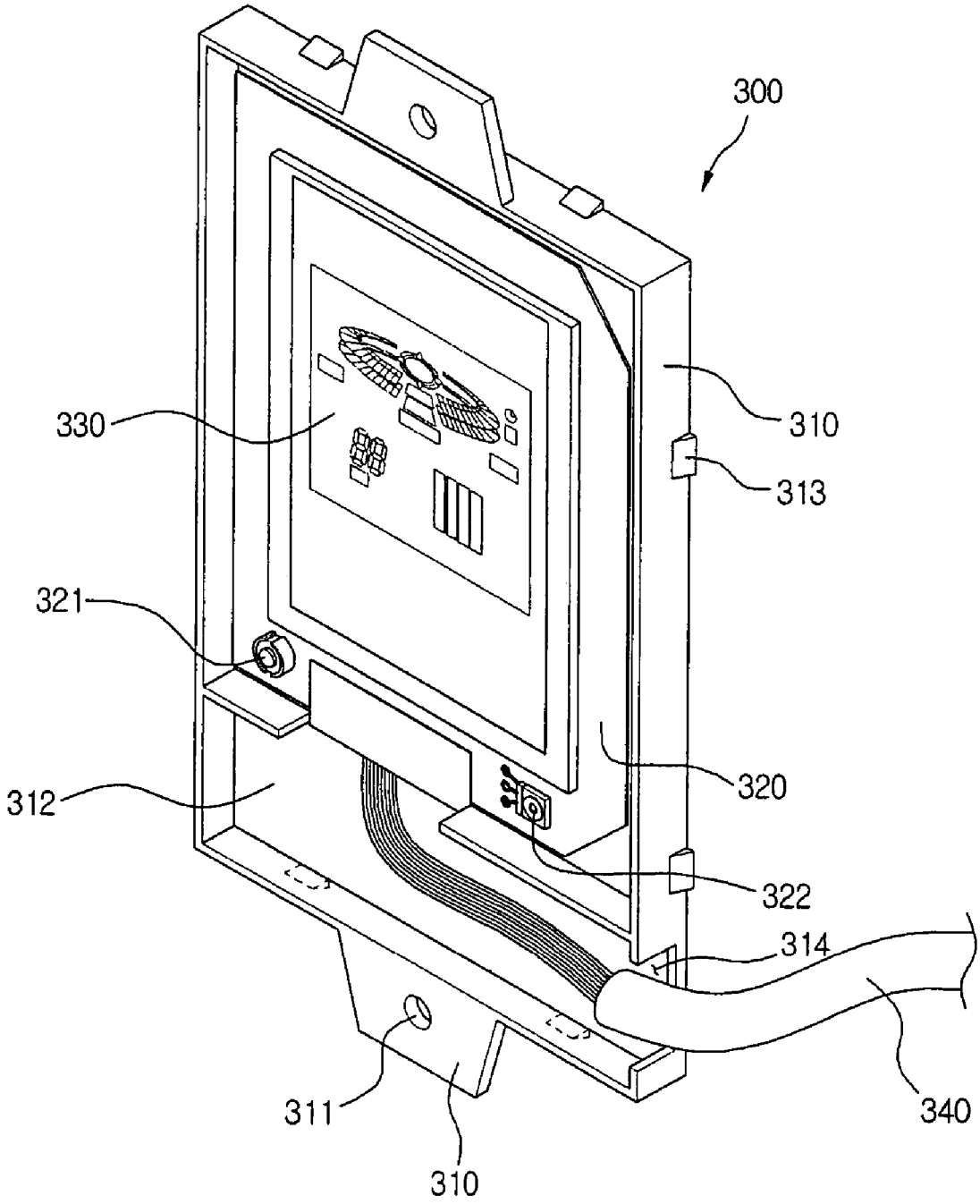

【Fig. 14】
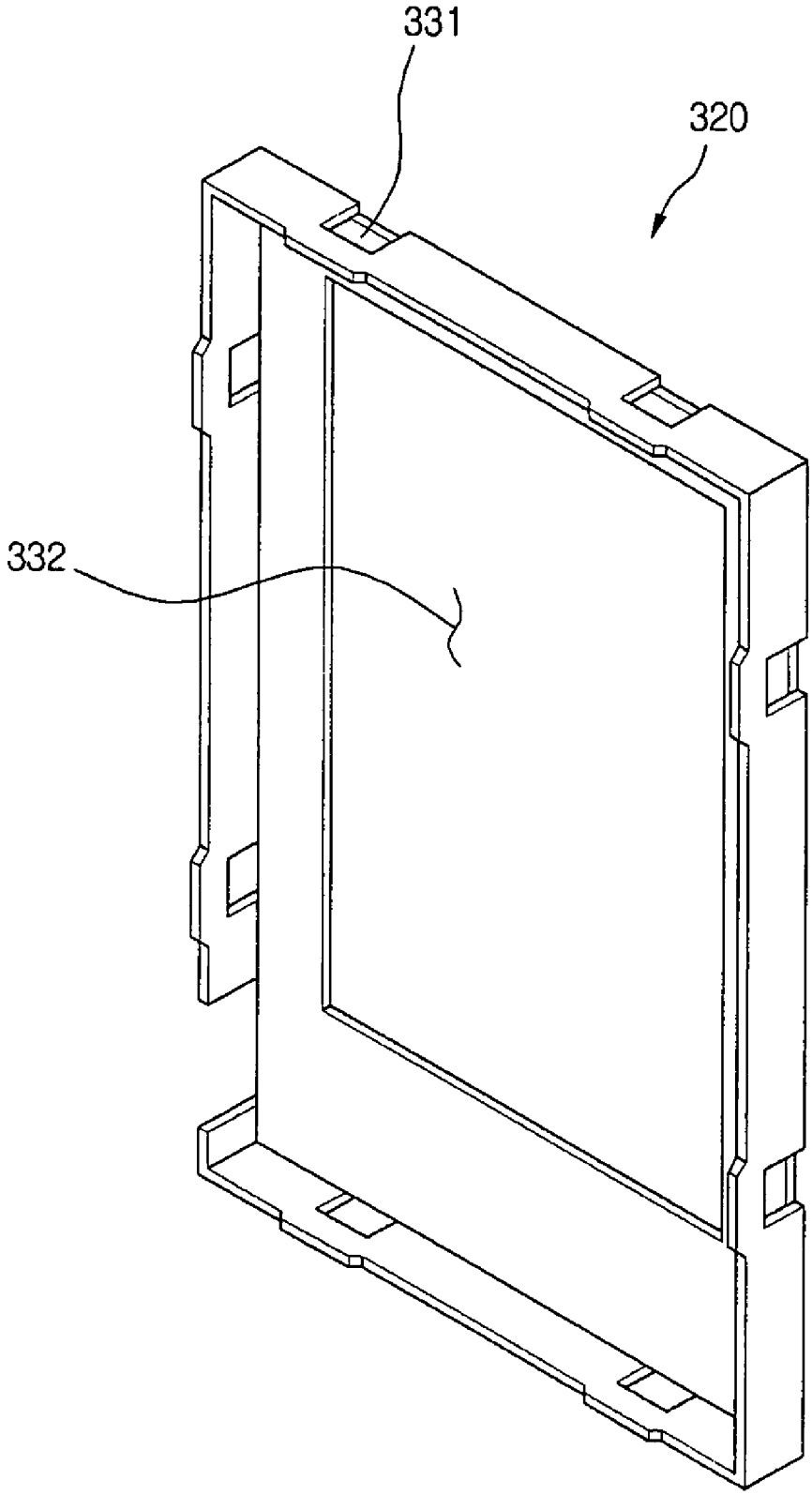

【Fig. 15】
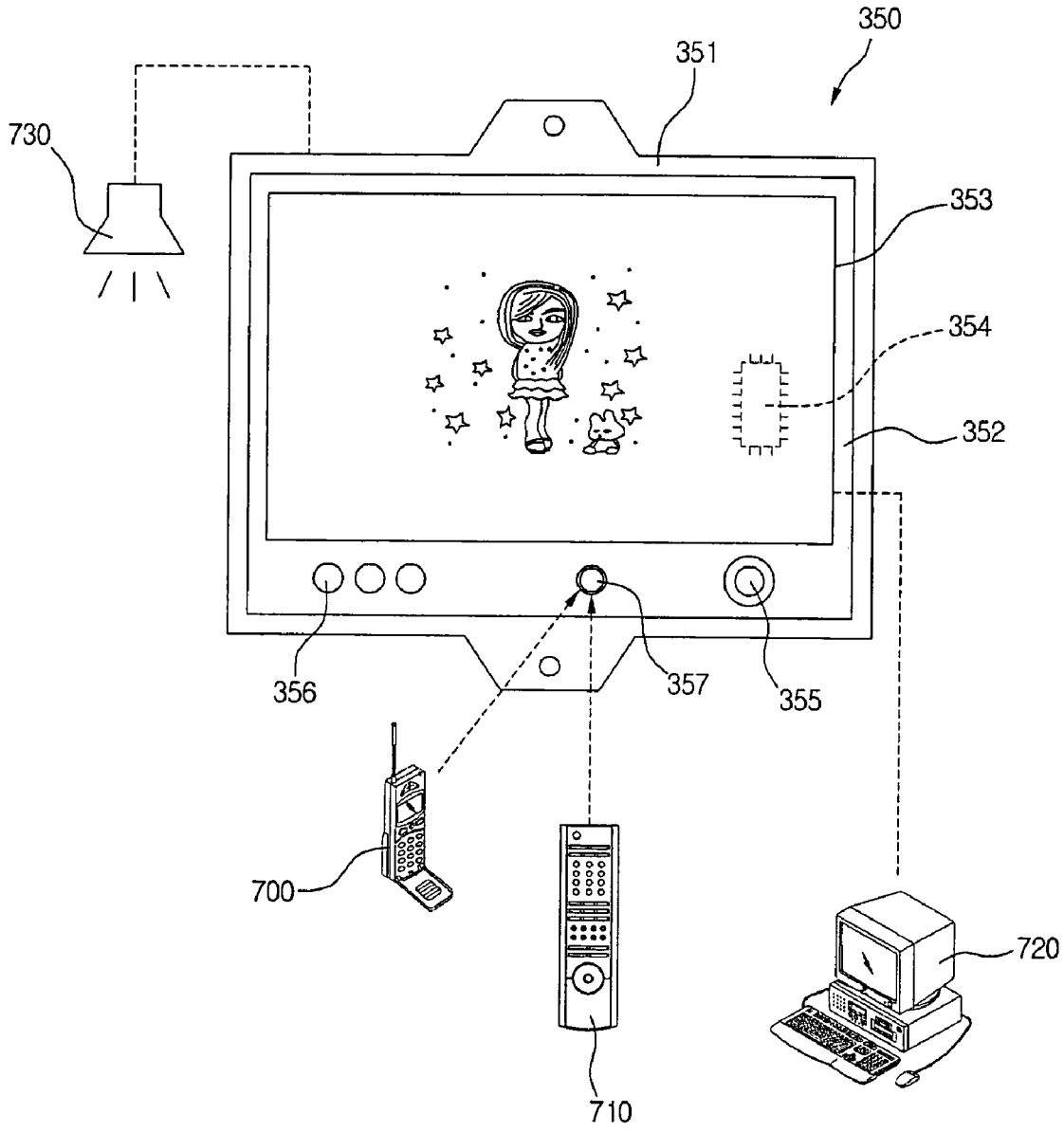

【Fig. 16】
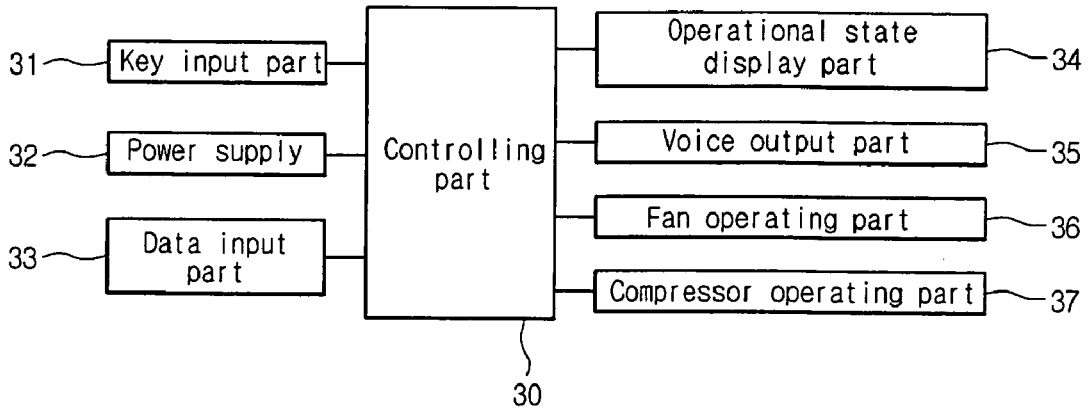
【Fig. 17】
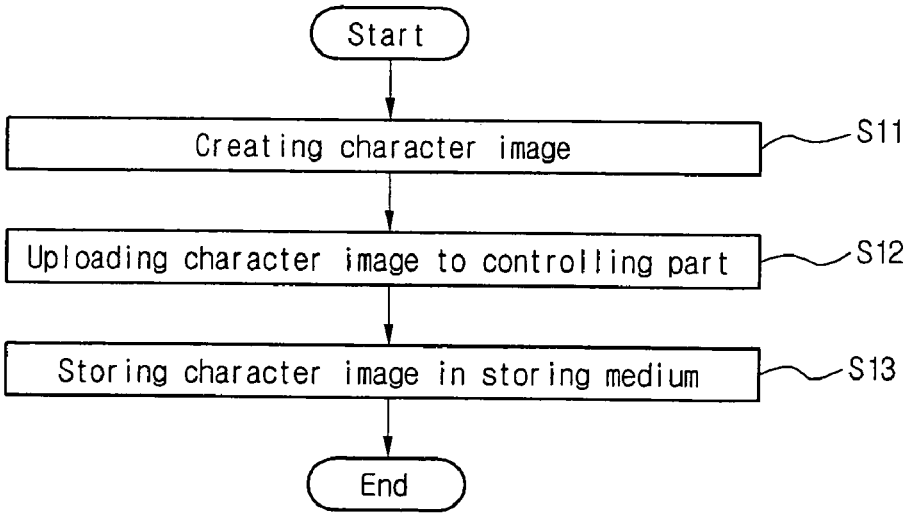

【Fig. 18】
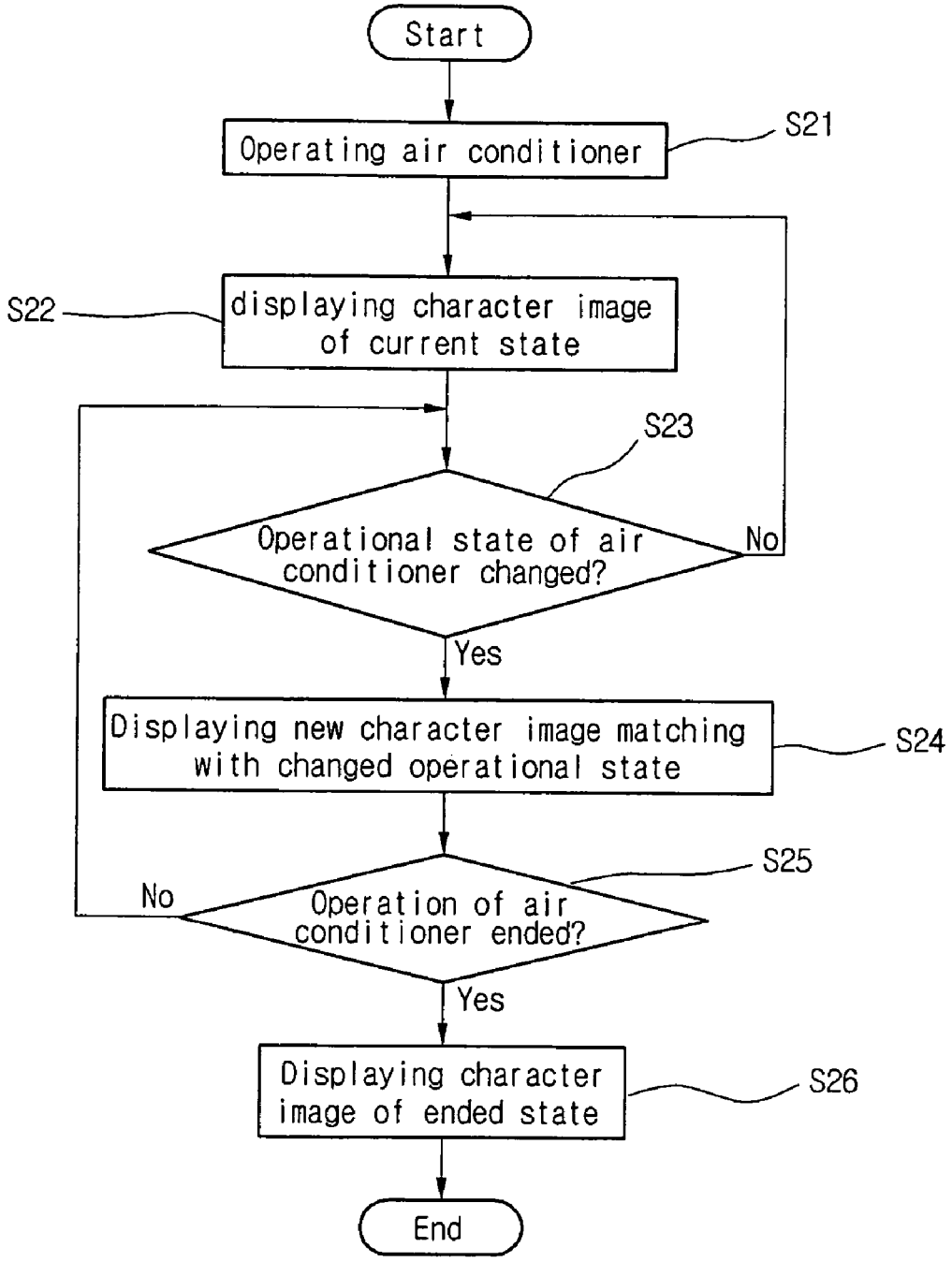

【Fig. 19】
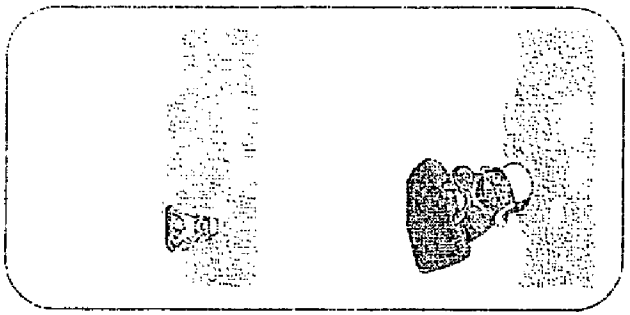
【Fig. 20】
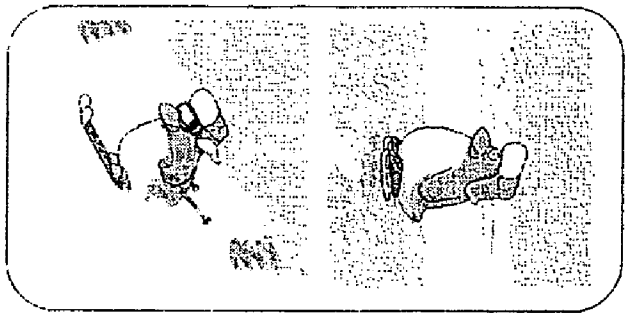

【Fig. 21】
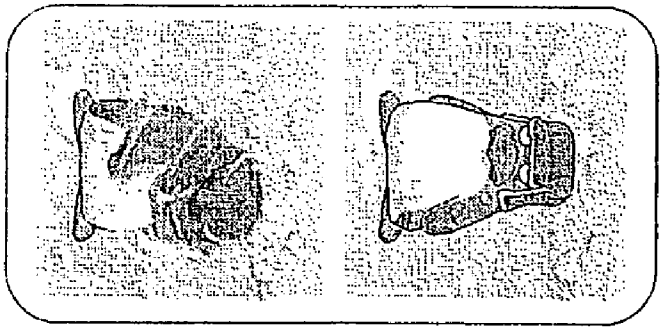
【Fig. 22】
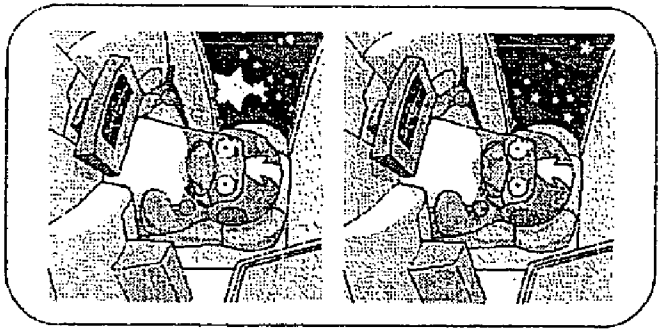

【Fig. 23】
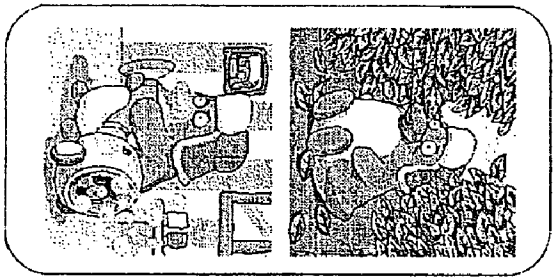
【Fig. 24】
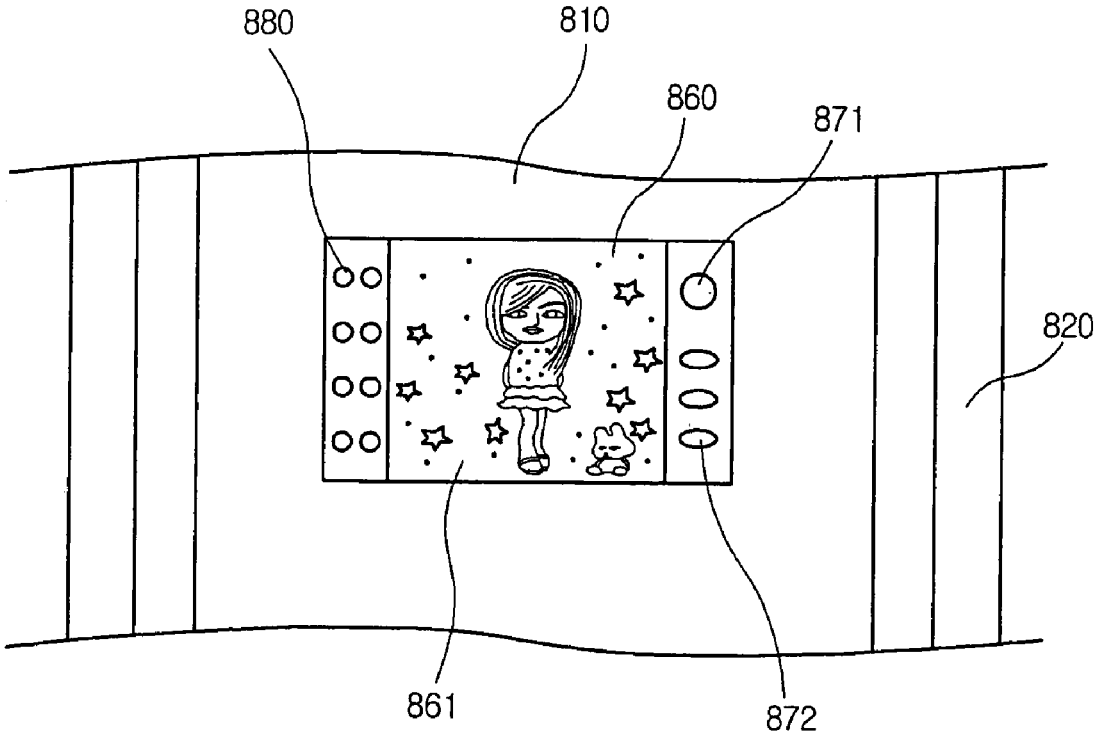

【Fig. 25】
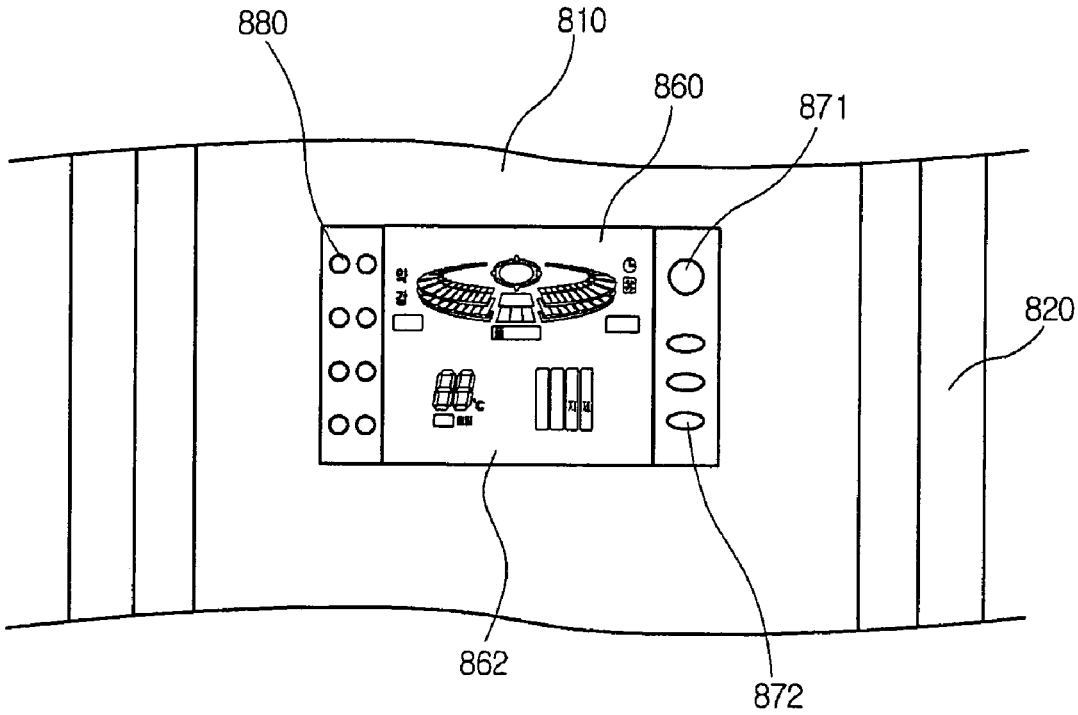

AIR CONDITIONER HAVING AN ENHANCED USER PERCEPTION

This Nonprovisional application claims priority under 35 U.S.C. § 119(a) on Patent Application No(s). 10-2003-0083541 filed in Korea, Republic of on Nov. 24, 2003, the entire contents of which are hereby incorporated by reference.

TECHNICAL FIELD

The present invention relates to an air conditioner, and more particularly, to an air conditioner capable of enhancing a user's perception. The air conditioner includes a display window at one side, so that an image adapted for the air conditioner or a character image having a user's high preference is displayed on the display window. Also, a manipulation operation of the air conditioner is more convenient through a change of the character image. Specifically, the present invention relates to an air conditioner which can suitably display the character image depending on an operational state, thereby enhancing a user's perception.

BACKGROUND ART

An air conditioner that is generally used at home includes a manipulation part, a display window on which an operational state of the air conditioner is displayed, and a driver part having a plurality of equipments suitable for a characteristic of the air conditioner. The display window is configured to simply display the operational state of the air conditioner with digit, arrow, shade, display of liquid crystal display (LCD), and so on. Because the display window which allows a user to observe the operational state of the air conditioner, is constructed too simply, the user cannot observe the operational state of the air conditioner at a glance. In other words, the user must look at digits or arrows near the air conditioner.

Specifically, among home appliances, the air conditioner is installed in an indoor space or wall of an office or house so as to heat or cool its interior. The air conditioner includes a compressor, a condenser, an expansion value and an evaporator and performs a series of a refrigeration cycle. Generally, the air conditioner has a plurality of operational states, such as a dehumidifying state, a cooling state, and a rapid cooling state. However, the user must approach the indoor unit of the air conditioner so as to identify the operational state of the air conditioner. Even if a display window is installed in an indoor unit, the user must look at an arrow or appellation of the operational state near the indoor unit. Also, the complex operational state of the air conditioner can be perceived through digits, letters, arrows, symbols, and so on.

As described above, the conventional air conditioner has drawbacks in that freshness and animation are lack because temperature, humidity and operational states are displayed in a static manner.

Also, an image displayed on the display window is predefined in a manufacturing step and cannot be changed. Therefore, the user is liable to be tired of the image and tends to purchase a new air conditioner, thereby reducing a use term of the air conditioner.

Meanwhile, a virtual reality using the Internet connected through networks has been recently in the spotlight. In such a virtual reality, individuals feel satisfied on the Internet using their own characters as the other selves. A variety of contents industries associated with them are growing. These characters are called "AVATA". Up to the present, the use of the AVATA is limited to the virtual space, which is connected through the Internet.

TECHNICAL PROBLEM

An object of the present invention is to provide an air conditioner having an enhanced user perception, in which a display window on which a character is displayed is provided at one side of the air conditioner, thereby improving a user's preference.

Also, an object of the present invention is to provide an air conditioner having an enhanced user perception, in which a character image displayed on a display window is changed depending on an operational state of the air conditioner, so that a user can perceive the operational state more conveniently. In order to enhance the user perception much more, the operational state of the air conditioner can be displayed in a voice.

Also, an object of the present invention is to provide an air conditioner, which can enhance a user satisfaction much more by making a whole set of characters, which are displayed on a display window, changeable depending on a user's preference. A use term is also extended.

Further, an object of the present invention is to provide an air conditioner, which can enhance a convenience in use of the air conditioner much more by implementing several kinds of display arrangement depending on a user's preference.

Further, an object of the present invention is to provide an air conditioner having an enhanced user perception, in which a display window disposed at a front side of the air conditioner can be stably fixed to increase a readability of the display window.

Further, an object of the present invention is to provide an air conditioner having an enhanced user perception, in which a display window can be assembled more conveniently and simply and a manufacturing process can be performed more conveniently.

TECHNICAL SOLUTION

In order to achieve the above objects, there is provided an air conditioner having an enhanced user perception, which includes: a panel forming an appearance of either side of the air conditioner; and a display part formed on the panel, for displaying a specific character and/or a character image of the character.

In another aspect of the present invention, an air conditioner having an enhanced user perception includes: a panel forming an appearance of either side of a home appliance; and a display part formed on the panel, for displaying a specific character and/or a character image of the character.

In a further another aspect of the present invention, an air conditioner having an enhanced user perception includes: a key input part manipulated by a user to control an operation of the air conditioner; an operational state display part for displaying a predetermined character and/or a character image of the character at least adapted for an operational state of the air conditioner; and a control part for judging a signal transmitted from the key input part to control the air conditioner and judging the character and/or the character image adapted for the operational state of the air conditioner to transmit a predetermined character and/or a character image to the operational state display part and allow the transmitted character and/or the character image to be displayed on the operational state display part.

ADVANTAGEOUS EFFECTS

According to the present invention, a user's own character image can be displayed on an air conditioner, so that the will to purchase the product and a user's satisfaction are increased.

Also, a character can be changed depending on a user's preference, thereby satisfying the user greater. In addition, since the character can be changed conveniently, a user's convenience is improved.

Also, an action of a character displayed on an air conditioner can be visibly changed in various shapes, depending on characteristics of operational states of the air conditioner. Therefore, the operational state of the air conditioner can be easily perceived. Due to a voice output part, the operational state can be perceived more reliably.

Further, a user can be greatly satisfied by recording his or her favorite person's voice for the voice output.

Further, in such a recent environment that a design of an air conditioner tends to have a strong influence on a selection of an air conditioner, a user's satisfaction and convenience in use of the product can be enhanced much more by uploading a user's favorite character image.

Further, since a display window of an air conditioner can be mounted reliably and stably, a process required for mounting the display window is simplified and the number of necessary parts is reduced. The user can correctly check a displayed state of the display window without regard to a use state of the air conditioner.

DESCRIPTION OF DRAWINGS

Embodiments of the present invention will be fully understood with reference to the accompanying drawings.

FIG. 8 is an exploded perspective view of a second indoor unit according to the present invention;

FIG. 9 is a front view illustrating a front panel of a second indoor unit according to the present invention;

FIG. 10 is a rear view of a front panel according to the present invention;

FIG. 11 is a perspective view illustrating a shape reinforcement member of a second indoor unit according to the present invention;

FIG. 12 is a front perspective view of a front frame according to the present invention;

FIG. 13 is a front view of a state display part according to the present invention;

FIG. 14 is a perspective view illustrating a top case of a state display part according to the present invention;

FIG. 15 is a view illustrating an operation of a display part according to the present invention;

FIG. 16 is a block diagram of an air conditioner according to the present invention, illustrating a control state of the air conditioner;

FIG. 17 is a flow chart illustrating a character image upload mode of an air conditioner according to the present invention;

FIG. 18 is a flowchart illustrating a character image display mode of an air conditioner according to the present invention;

FIG. 19 is an exemplary view of a character image displayed in a start/stop mode of an air conditioner;

FIG. 20 is an exemplary view of a character image displayed in a cooling operation mode of an air conditioner;

FIG. 21 is an exemplary view of a character image displayed in a dehumidifying operation mode of an air conditioner;

FIG. 22 is an exemplary view of a character image displayed in an artificial intelligence operation mode of an air conditioner;

FIG. 23 is an exemplary view of a character image displayed in a plasma cleaning operation mode of an air conditioner;

FIG. 24 is a view of a character image displayed on a display part according to a second embodiment of the present invention; and FIG. 25 is a view of an operational state of an air conditioner, which is displayed on a display part.

BEST MODE

The preferred embodiments of the present invention will be described in detail with reference to the accompanying drawings. While the present invention will be particularly shown and described with reference to exemplary embodiments thereof, it will be understood by those of ordinary skilled in the art that various changes in form and details may be made therein without departing from the spirit and scope of the present invention of the present invention as defined by the following claims. Although an air conditioner is exemplarily described herein, the present invention can be applied to other home appliances.

FIRST EMBODIMENT

Figure 1:
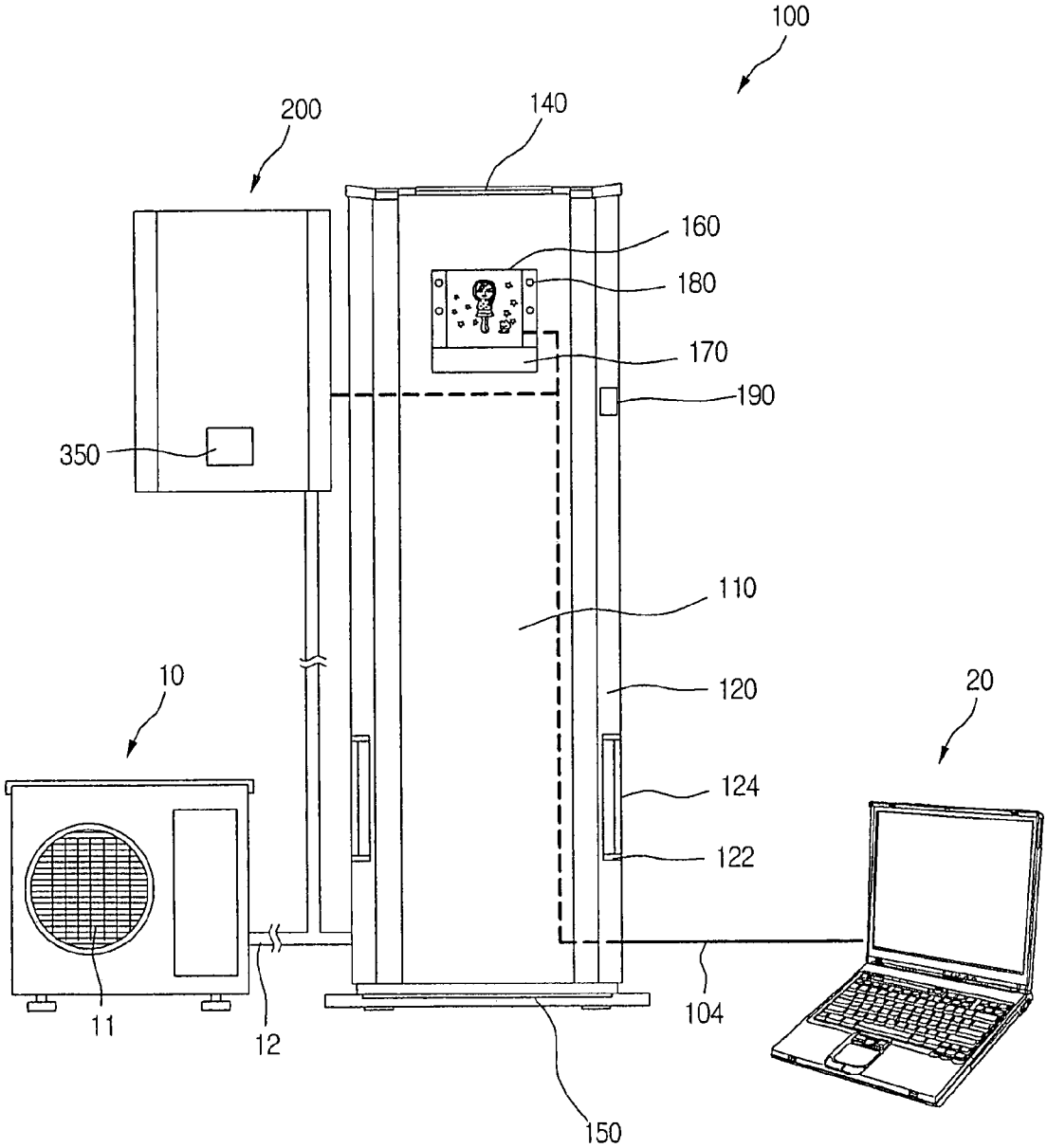
FIG. 1 is a view illustrating a use state of an air conditioner according to the present invention.

FIG. 1 is a view illustrating a use state of an air conditioner according to the present invention.

Referring to FIG. 1, an air conditioner according to the present invention includes a first indoor unit installed in an interior of a building, a second indoor unit 200 installed in a different space spaced apart from the first indoor unit 100, an outdoor unit 10 communicating with the indoor units 100 and 200 through a refrigerant pipe 12, and a data input part 20 for controlling display windows of the indoor units 100 and 200.

Also, the data input part 20 is connected with the indoor units 100 and 200 through a cable 104. The outdoor unit 10 includes an outdoor fan 11 for performing a heat exchange with respect to a refrigerant. The data input part 20 may be a computer that is widely used at home. At least one of the cable 104, a network and a wireless communication network can be applied to the computer 20.

Also, the indoor units 100 and 200 include display parts 160 and 350 on which at least character image is displayed. A variety of character images can be applied depending on kinds of the air conditioner. For example, a penguin image can be applied to an air conditioner and a duck image can be applied to a cooker. The character images may be previously stored in a storage medium provided inside the air conditioner, or may be directly inputted through the data input part 20 by a user. The character image is so large that the user can look the character image from a long distance and perceive the shape of the character image. The character may be an animal-shaped image. Except for the animal-shaped image, a mascot-like image whose meaning is perceivable may be used.

Further, each of the display parts 160 and 350 can further include a state display window for accurately display an operational state of the air conditioner with a numerical value or arrow, as well as the character image.

Further, although one outdoor unit and two indoor units are exemplarily shown in this embodiment, the present invention can also be applied when one indoor unit is used. This is also included within the spirit and scope of the present invention. Among the above indoor units, the first indoor unit 100 is a floor standing type indoor unit and the second indoor unit 200 is a wall mount type indoor unit. Since a plurality of indoor units are installed in separated indoor spaces, the heating/cooling can be perfectly achieved with regard to a overall indoor area.

An operation of the air conditioner constructed as above will now be described in brief. First, a refrigerant to which a heat exchange is performed by the outdoor unit 10 flows through the pipe 12 to the indoor units 100 and 200, and the heating/cooling operation performed by the indoor units can be easily understood. Predetermined character images are displayed on the display parts 160 and 350 of the air conditioner. The character images may be an image that is previously stored in a storage medium provided inside the air conditioner, or an image that is arbitrarily inputted through the data input part by the user.

Also, the character images displayed on the display parts 160 and 350 may be an equal character but different image representing a corresponding operational state, depending on the operational states of the air conditioner. The character images may also be a still picture.

Since the character images are displayed in the above manner, the user can conveniently perceive the operational state of the air conditioner, and the convenience in use of the air conditioner and the product image can be improved much more.

Figure 2:
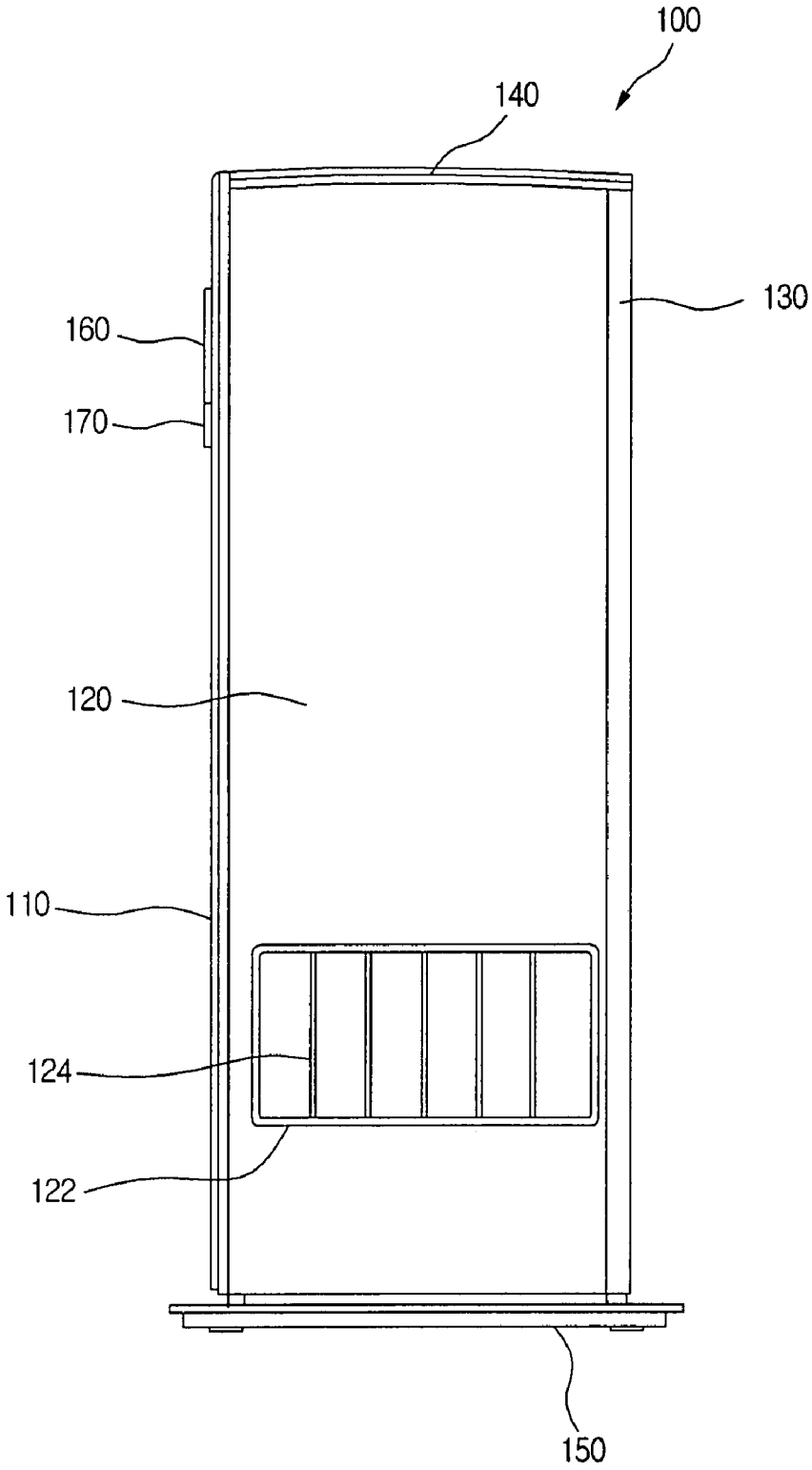
FIG. 2 is a side view of a first indoor unit according to the present invention.

FIG. 2 is a side view of the first indoor unit 100 according to the present invention.

Referring to FIGS. 1 and 2, the first indoor unit 100 includes a front panel 110 elongated up and down to form a front appearance, a side panel 120 forming a side appearance, a rear panel 130 forming a rear appearance, an upper panel 140 forming an upper appearance, and a base pan 150 forming a bottom surface.

A user interface part disposed adjacent to the display part 160 will be described in detail. The display part 160 is disposed at an upper center of the front panel 110. A set character image is displayed on the display part 160. The display part 160 includes a liquid crystal display (LCD) and/or a light emitting device (LED). The character image may be an AVATA or any other images.

The LCD is a display device to which an operation of liquid crystal (LC) is applied. The liquid crystal will now be described in detail. Liquid crystal molecule is an intermediary substance between a liquid state and a solid state. The liquid crystal molecule is called an an isotropic liquid, because the molecular arrangement is regular in a certain direction, while the molecular arrangement is irregular in a different direction and the liquid crystal is optically in a crystal state. The liquid crystal that is an organic molecule having liquidity like a liquid is regularly arranged like a crystal. The LCD displays an image using a property that the molecular arrangement is changed due to an external electric field. The LCD has characteristics of slimness, light weight and low power consumption regardless of a screen size. Therefore, the LCD can be conveniently installed in the air conditioner having a narrow space. Also, the LCD can reproduce full colors using red, green and blue colors. Therefore, a colorful character image can be implemented without troubles. Since an operation principle of the LCD and a color reproducing method of a back light have been well known, their detailed descriptions will be omitted. Further, since the LED reproduces the red, green and blue colors through a light emitting semiconductor device, it can act as a display device and may be adapted for a large screen. Since the LCD can reproduce various colors, a user's aesthetic sense and preference to the product are enhanced much more.

The character image can be displayed in various shapes, and various AVATAs can be displayed depending on the operational states of the air conditioner. Specifically, the AVATA is used to exhibit the otherself of a specific individual on the virtual space. A specific character is disposed in various poses, locations, backgrounds and features without any change in the subject of the character. Therefore, it is useful to show various features to the user. For example, when the air conditioner is turned on, the character appears and greets with a bright smile. While the air conditioner is operating, the character acts variously depending on the operation modes. In other words, in a "cooling operation", the character plays ball with a penguin, and in a "dehumidifying operation", the character squeezes water from the clothes. Further, the character is different depending on a current temperature. For example, if the current temperature is higher than a desired temperature, the character perspires profusely, and if the current temperature is lower than the desired temperature, the character shrinks with cold. At this time, it is preferable to use the same character.

Also, the first indoor unit 100 is configured to inform the current operational state and temperature of the air conditioner with voice, in addition to the character image. In detail, the current state and operational state of the air conditioner are informed through a speaker in a human voice under a control of a controller (not shown), for example, "This air conditioner is now in the cooling operation", "A current temperature is 26 degrees", or "A current air flow is strong". The information can be expressed corresponding to the shape of AVATA or separately without association with it. For this purpose, a storage medium and/or microphone for a recording function are/is provided inside the first indoor unit 100. The user can record his or her own voice or replace the set voice with a separately recorded sound. Therefore, the operational state of the air conditioner is informed with the user's own voice or a separate melody. Of course, the voice can be stored through the data input part 20.

Also, the LCD of the display part 160 is set to a power saving mode in operation. If the operation of the air conditioner is stopped, the AVATA displayed on the display part 160 greets and disappears.

A receiving unit is further provided inside the first indoor unit 100 so as to download the AVATA through a direct connection or wireless connection with an external unit. The AVATA can be downloaded via the Internet, a line telephone and a cellular phone.

The data input part 20 is connected to the indoor units 100 and 200. The data input part 20 is connected to the indoor units 100 and 200 through the cable 104, and more particularly, to the controller for controlling the display part 160. Thus, the user can directly create or program desired character on the computer 20 and upload it to the controller. In addition, the user can download it through the communication networks, such as the Internet or the telephone. In other words, the user can access the Internet through the computer 20, download the character provided from a corresponding website, and upload it to the controller. Also, the user can download the character through a mobile equipment such as a cellular phone and transmit it to the controllers of the indoor units 100 and 200.

Figure 3:
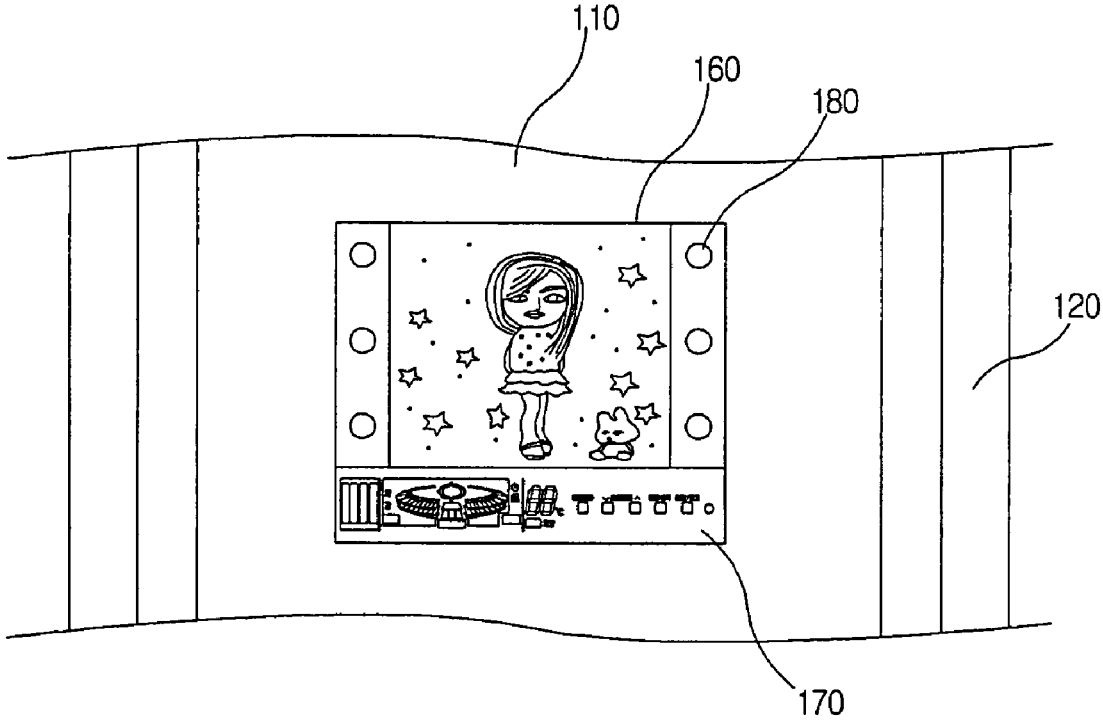
FIG. 3 is a partial enlarged view of a front panel according to the present invention.

Referring to FIG. 3, a state display part 170 is further provided in a lower portion of the display part 160. The state display part 170 displays the operational state of the air conditioner with diagrams, letters and numerical values. Like the display part 160, the state display part 170 can be configured with an LCD or LED. Also, a plurality of manipulation buttons 180 are provided on both sides of the display part 160. The operation of the air conditioner can be set using the manipulation buttons 180. Further, the manipulation buttons are used to set or modify the display part 160. Of course, the air conditioner can be operated by a remote controller.

FIG. 3 is a partial enlarged view of the front panel of the air conditioner according to the present invention. A construction of the display part 160 will be fully understood with reference to FIG. 3.

Figure 4:
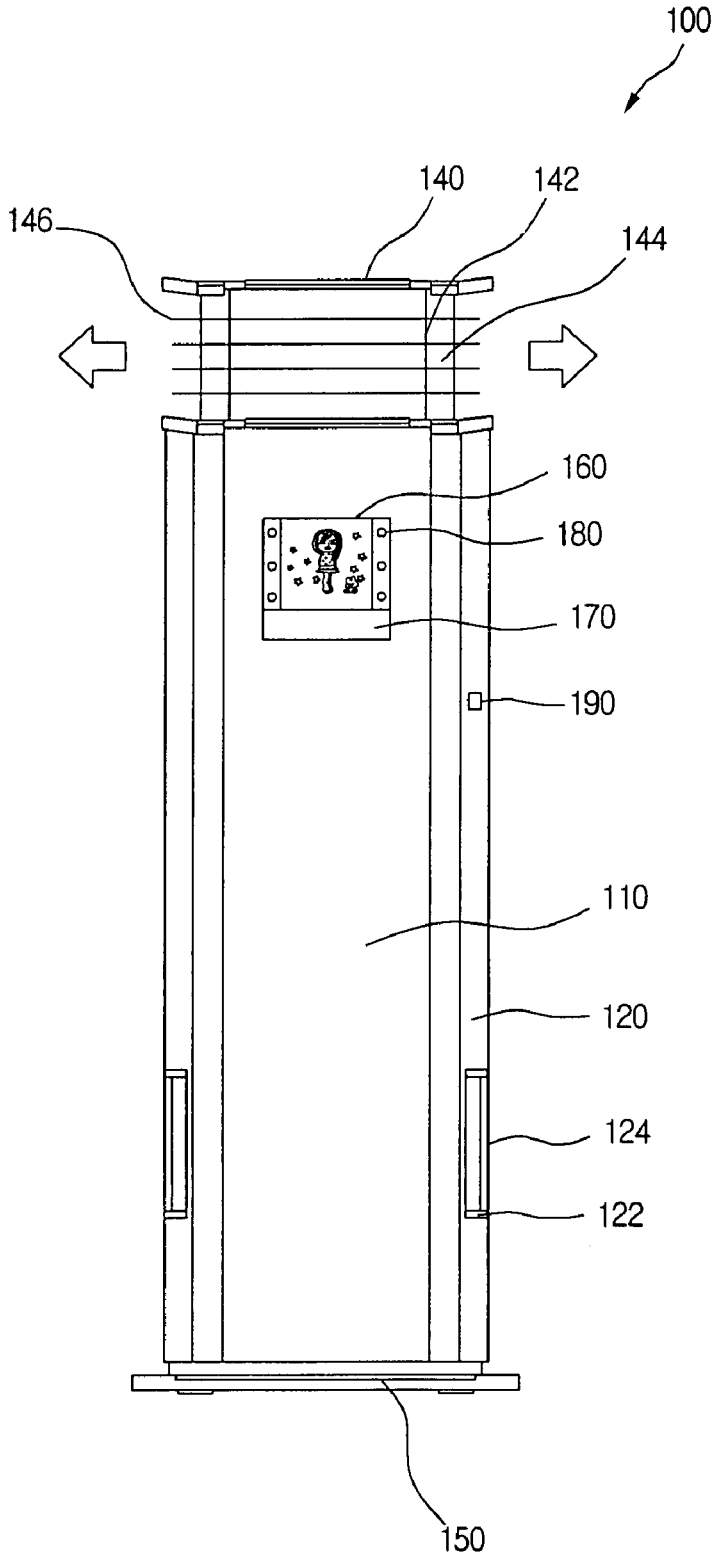
FIG. 4 is a front view illustrating an operation of an air conditioner according to the present invention.

Referring to FIG. 4, a functional operation of the air conditioner will now be described in brief. An inlet port 122 is formed at the side panel 120 providing a side appearance of the first indoor unit 100. An air is introduced from an indoor space through the inlet port 122. An inlet grill 124 is further installed in an outer side of the inlet port 122. An air filter (not shown) for filtering foreign substance contained in the introduced air is further provided in an inner side of the inlet grill 124.

The upper panel 140 moves up and down. In other words, the upper panel 140 is supported by a supporter 142, which is provided in right and left sides and front and rear sides, and moves upwards. At the rear side, a rear blocking plate 144 slides from an upper end of the first indoor unit 100 and is protruded upwards. A plurality of outlet ribs 146 are formed in right and left sides of the supporter 142. The outlet ribs 146 are formed up and down spaced apart from each other by a predetermined interval. The outlet ribs 146 guide a discharge direction, so that the air discharged from the inside of the first indoor unit 100 upwards can be discharged in a front or side direction.

Also, a heat exchanger (not shown) is installed inside the first indoor unit 100, allowing a heat exchange between the air introduced through the inlet port 122 and the refrigerant flowing through the first indoor unit 100. A blowing fan (not shown) and a motor (not shown) are embedded. The blowing fan forcibly blows the air so as to again discharge the air, which is introduced through the inlet port 122, to the indoor space through the upper end of the first indoor unit 100. The motor produces a rotational power to the blowing fan.

In addition, the outdoor unit 10 performs a refrigeration cycle of the air conditioner together with the indoor units 100 and 200. Although not shown, a plurality of parts, such as a compressor for compressing the refrigerant and an outdoor heat exchanger for performing a heat exchange, are embedded in the inside of the outdoor unit 10.

Figure 5:
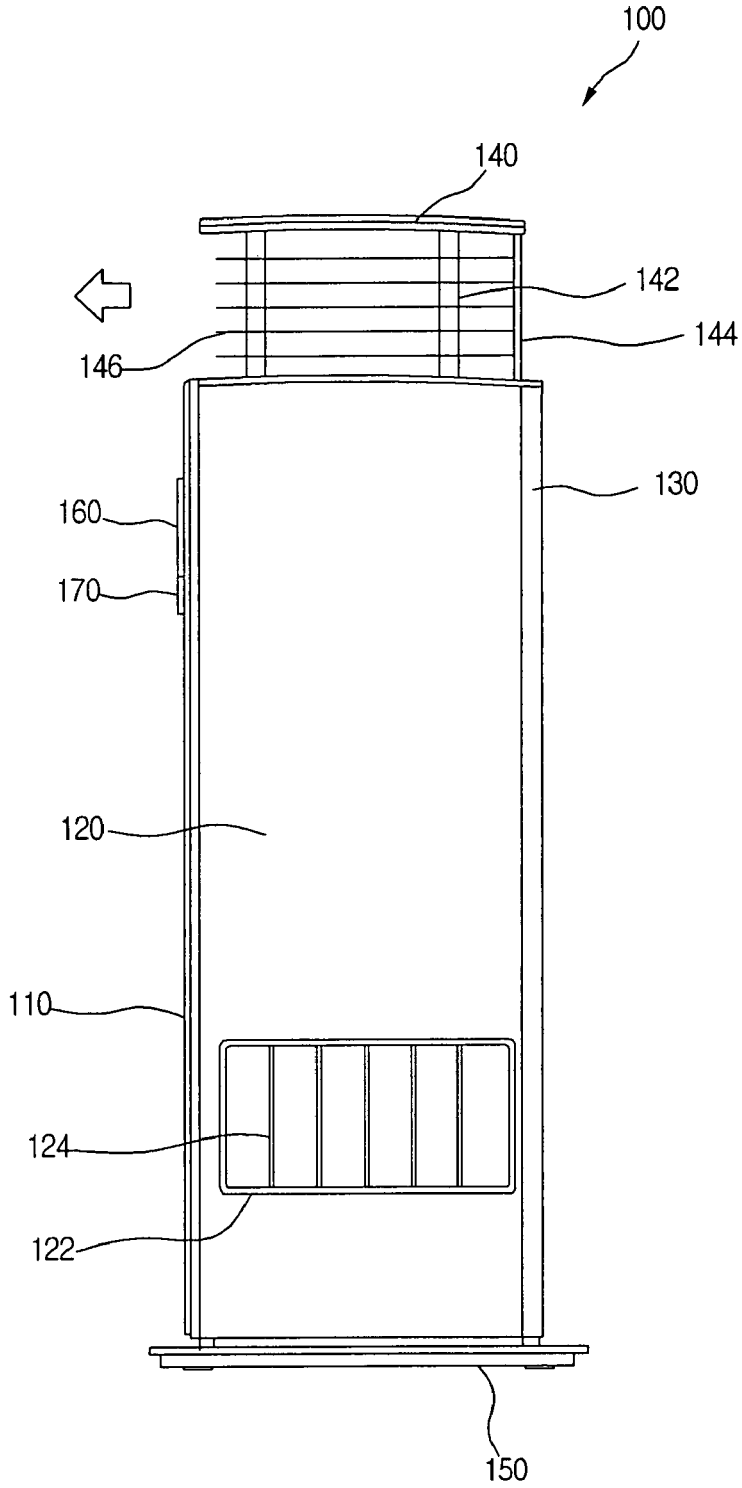
FIG. 5 is a side view illustrating an operation of an air conditioner according to the present invention.

FIGS. 4 and 5 are a front view and a side view illustrating an operation of the air conditioner according to the present invention, respectively.

An operation of the air conditioner, specifically the first indoor unit 100, will be described with reference to FIGS. 4 and 5. First, a case when the air conditioner operates in a cooling mode will be described below.

The air conditioner is driven using the remote controller or by pressing the manipulation button 180. If the air conditioner begins to operate, the air of the indoor space is introduced into the first indoor unit 100 through the inlet port 122. The air filter (not shown) filters foreign substance from the introduced air. The heat exchanger (not shown) provided inside the first indoor unit 100 performs a heat exchanger between the air and the refrigerant, thereby reducing the temperature. At this time, the heat exchanger provided inside the first indoor unit 100 acts as the evaporator. Therefore, the air introduced from the indoor space is deprived of heat by the refrigerant flowing through the heat exchanger, thereby reducing the temperature. The cooled air is introduced into the blowing fan (not shown). The blowing fan (not shown) forcibly blows the air upwards and discharges it into the indoor space.

Meanwhile, when the air conditioner operates, the upper panel 140 moves upwards. Accordingly, the outlet rib 146 provided in the supporter 142 is exposed externally. The air which is forcibly blown upwards by the blowing fan, collides with a bottom surface of the upper panel 140 and circles in a lateral direction. The rear blocking plate 144 is integrally formed at the rear end of the upper panel 140. The rear blocking plate 144 slides upwards together with the upper panel 140 and is exposed. Therefore, the air discharged upwards is not discharged in a rear direction but discharged a front or side direction. At this time, the air is discharged toward the indoor space in such a state that the discharge direction is adjusted by the outlet rib 146. As a result, the air discharged into the indoor space is a cooled air, whose heat is exchanged by the heat exchanger. Therefore, a cool air is supplied to the indoor space and thus a cooling operation is achieved.

Meanwhile, like the first indoor unit 100, a heat exchange is also performed in the outdoor unit 10 (shown in FIG. 1, but not shown in FIGS. 4 and 5). In other words, when the air conditioner operates in the cooling mode, the heat exchanger of the first indoor unit 100 acts as the evaporator, while the heat exchanger of the outdoor unit 10 acts as the condenser. Accordingly, the temperature of the external air introduced into the outdoor unit 10 is increased and then discharged into the outside. In this manner, the cooling operation is performed in the first indoor unit 100 and the heating operation is performed. As a whole, one refrigeration cycle is achieved.

When the air conditioner operates in the cooling mode, the display part 160 is also turned on so that various AVATAs appear and inform the operational states of the air conditioner. For example, when the air conditioner is initially turned on, the set AVATA appears and greets with a bright smile. In the cooling mode, an image that the AVATA plays ball with a penguin in the South Pole can be displayed. Of course, if the user sets other character, other shape can be displayed. If the cooling operation is still necessary because the current temperature does not reach the set temperature, an image that the AVATA perspires profusely can be displayed.

Also, while the air conditioner operates, the operational state can be informed in the voice, except that the character is displayed on the display part 160. For example, when the air conditioner operates in the cooling mode, a message of "this air conditioner is now in the cooling operation" is outputted through the speaker 190. If the user inputs a recorded voice or melody, a corresponding message may be outputted.

A case when the air conditioner operates in the heating mode will now be described.

Like the cooling mode, a heat exchange is performed with respect to the indoor air introduced through the inlet port 122 of the first indoor unit 100. Then, the air is again discharged into the indoor space through the upper end of the first indoor unit 100. At this time, the refrigeration cycle is reversibly performed. Therefore, the heat exchanger embedded in the first indoor unit 100 acts as the condenser, so that the temperature of the introduced indoor air rises. As described above, when the air conditioner is turned on, the display part 160 is also turned on to display the greeting AVATA. If the user selects the heating mode, the set image of the AVATA is displayed. For example, an image that the AVATA bathes in the sea can be displayed. Also, various images can be displayed depending on the programs set by the user.

Simultaneously, a message of "this air conditioner is now in the heating operation" is outputted through the speaker 190 (shown in FIG. 1, but not shown in FIGS. 4 and 5). Such a message can also be variously changed depending on the user's setup.

Also, if the current temperature is lower than the desired temperature, an image that the character shrinks with cold can be displayed.

If the user turns off the air conditioner, the AVATA greets cutely and disappears. In this manner, the heating operation of the air conditioner can be ended.

Meanwhile, if the user does not like the character image and voice from the display part 160 or if the user wants to use his or her own character image and voice, the program can be downloaded using the communication equipment, such as the Internet or cellular phone, or can directly input it.

FIGS. 6 to 15 are views illustrating the construction and operation of the second indoor unit in the air conditioner according to the present invention. The second indoor unit is the wall mount type and has a small size, so that an installation space for the display part is small and an air discharge space is narrow. Therefore, an additional structure for mounting the display part is required. Thus, the second indoor unit must be formed in a specific structure, which can meet such requirements.

Figure 6:
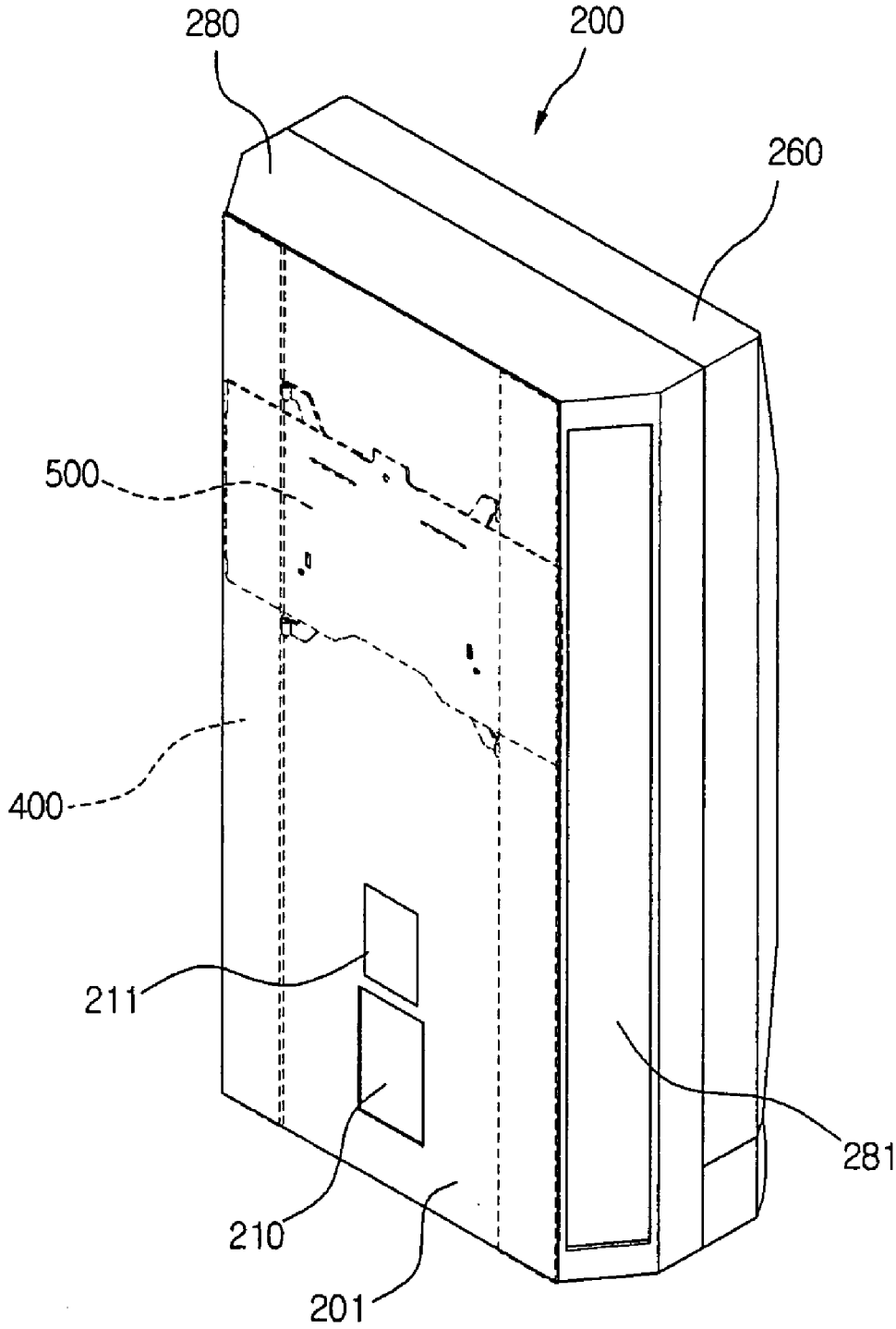
FIG. 6 is a front perspective view of a second indoor unit according to the present invention.
Figure 7:
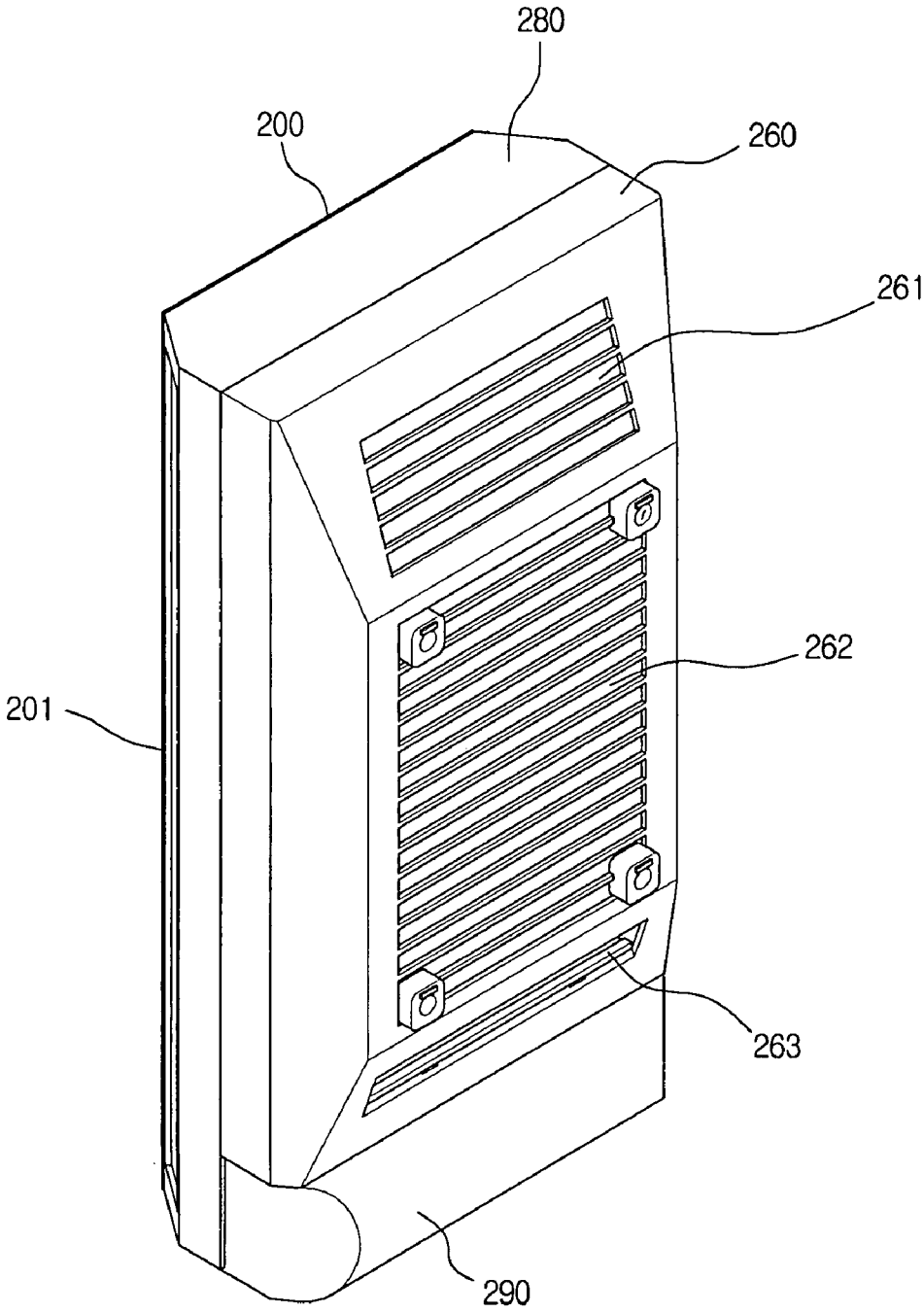
FIG. 7 is a rear perspective view of a second indoor unit according to the present invention.

FIGS. 6 and 7 are a front perspective view and a rear perspective view of the second indoor unit according to the present invention, respectively.

Referring to FIGS. 6 and 7, the second indoor unit 200 according to the present invention includes: a front panel 201 forming a front surface of the second indoor unit 200; a front frame 280 into which the front panel 201 is fitted to thereby form a front cover, in which the front frame 280 has outlet ports 281 on both sides; an outlet opening/closing unit 500 mounted between the front frame 280 and the front panel 201; an outlet door 400 connected to the outlet opening/closing unit 500, for opening/closing the outlet port 281; a base 260 connected to the front frame 280 to thereby form a rear cover; and a pipe cover 290 formed in a lower side of the second indoor unit, for receiving a variety of pipes.

In detail, the outlet port for discharging the introduced indoor air is formed at a predetermined position of the front frame 280, and the inlet port for introducing the indoor air is formed at a predetermined position of the base 260. In other words, an upper inlet port 261 is formed at an upper inclination surface of the base 260 and a central inlet port 262 is formed at a central surface of the base 260. It is apparent that an additional inlet port can be formed on both sides of the inclination surface of the base 260. A mesh-type grill is formed at the inlet ports 261 and 262, so that impurities contained in the air introduced into the second indoor unit 200 are primarily filtered.

Also, a filter insertion hole 263 may be further formed at a lower side of the base 260 so as to re-filter fine foreign substances contained in the indoor air, which is primarily filtered by the inlet grill formed between the upper inlet port 261 and the central inlet port 262.

Further, a display window 210 for displaying the character image and an operation display window 211 for displaying the operational state of the air conditioner are formed at predetermined positions of the front panel 201. Thus, the user can be conveniently informed of the operational state of the overall air conditioner including the second indoor unit 200. Like the first indoor unit 100, the user's perception and convenience can be enhanced much more by displaying the character image on the display windows.

A flow of the air introduced into the second indoor unit 200 will now be described in detail. The air introduced into the second indoor unit 200 is introduced through at least one or more inlet ports 261 and 262 and the filter insertion hole 263, which are formed at one side of the base 260, and then, it is discharged through at least one outlet port 281, which is formed at one side of the front frame 280.

FIG. 8 is an exploded perspective view of the second indoor unit according to the present invention.

Referring to FIG. 8, the second indoor unit 200 of the air conditioner according to the present invention includes: a front panel 201 forming a front appearance of the second indoor unit 200; a front frame 280 in which the front panel is fitted to thereby form a front surface; a blowing fan 235 formed at a rear side of the front frame 280, for introducing the indoor air; an orifice 240 formed at a rear side of the blowing fan 235, for guiding the direction of the air introduced by the rotation of the blowing fan; a heat exchanger 250 formed at a rear side of the orifice 240, for contacting with the introduced air to thereby decrease the temperature of the introduced air; and a base 260 formed at a rear side of the heat exchanger 250 and connected to the front frame 280.

Also, an outlet opening/closing unit 500 is provided between the front panel 210 and the front frame 280 so as to open/close the outlet port 281. The second indoor unit can be assembled in order of the front panel 201, the front frame 280, the blowing fan 235, the orifice 240, the heat exchanger 250 and the base 260.

In detail, the orifice 240 includes: an air guide hole 245 for guiding the introduced air toward the blowing fan 235; an upper air guide 241 formed at an upper side so as to guide the indoor air introduced through the air guide hole 245 toward both sides; a lower air guide 242 formed at a lower side so as to guide downwards the indoor air introduced through the air guide 245; and a lower outlet door 243 for dispersedly discharging the air guided by the lower air guide 242 toward the interior.

In addition, a motor for rotating the blowing fan 235 and an electronic component part 249 for controlling the driving of electronic components are further provided at an upper space between the front frame 280 and the orifice 240. A drain pan 270 is further provided at a lower side of the heat exchanger 250 so as to gather a condensate water formed on the surface of the heat exchanger 250.

Further, a pipe cover 290 for receiving a variety of pipes connected with the drain pan 270 and the second indoor unit 200 is provided at a lower side of the drain pan 270. In this manner, the second indoor unit of the air conditioner according to the present invention is provided.

A function and operation of the respective parts will now be described.

First, the front panel 201 is attached to the front surface of the second indoor unit 200, thereby forming an outer appearance of the second indoor unit elegantly. Windows 210 and 211 are formed at one side of the front panel 201 so as to display the operation and/or operational state of the second indoor unit 200. In order to make the appearance of the second indoor unit look neat and beautiful, finishing materials may be used or a design is added. A detailed description of the front panel 201 will be described later.

Also, the front panel 201 is attached to the front frame 280 and a framework of the front frame 280 can be inclined at a predetermined angle. a side outlet port 281 and a lower outlet port 283 can be formed in at least one side of the framework so as to discharge the air, which is introduced into the second indoor unit 200 and cooled through the heat exchanger 250. The front panel 201 can be fixedly attached to the front frame 280. A hinge can be provided at one side so as to make the front panel 201 movable right and/or left, and the outlet port can be formed at the front side of the second indoor unit 200.

In addition, the blowing fan 235 is rotated by the motor attached to a rear side of the front frame 280, so that the indoor air is introduced inside the second indoor unit 200. At least one blowing fan 235 can be installed depending on size and use of the second indoor unit 200.

The orifice 240 functions to guide a flow of the air introduced toward the blowing fan 235. A flowing direction of the air introduced through the guide hole 245 is determined by the air guides 241 and 242 and the air is discharged through the outlet ports 281 and 263. The air guide 241 can be formed in various shapes depending on the direction and number of the outlet port.

Further, a wind direction controller 244 and a safety net 246 are further provided. The wind direction controller 244 is attached to both sides of the orifice 240 and is rotating at a predetermined angle, thereby controlling the direction of the discharged cool air. The safety net 246 protects the user or children from the blowing fan 235 when they touch it.

The heat exchanger 250 includes a heat exchange pipe, which is curved several times. A low temperature and low pressure refrigerant passing through an expander flows through the heat exchange pipe 251. Therefore, the air introduced into the second indoor unit 200 is deprived of heat while passing the heat exchanger 250, and thus becomes a low temperature state. During this process, moisture contained in the introduced air is cooled and thus condensed on the surface of the heat exchanger 250. A cooling effect becomes more excellent as an area of the heat exchanger 250 is wider. Therefore, the heat exchanger 250 can be formed in a flat rectangular shape or inclined at a predetermined angle. The drain pan 270 is formed at a lower side of the heat exchanger 250 so as to gather a condensate water formed on the surface of the heat exchanger 250 and prevent the condensate water from being leaked from the second indoor unit 200.

Also, the base 260 includes: an upper inlet port 261 formed at an upper side, for introducing the indoor air; and a central inlet port 262 formed at a central portion of the base 260. The shape and number of the inlet port can be freely selected depending on a volume and shape of the second indoor unit. A grill is formed at the inlet ports 261 and 262, with spaced apart by a predetermined interval and crossed with each other. Therefore, impurities contained in the indoor air introduced into the second indoor unit 200 are primarily filtered. A filter insertion hole 263 may be formed at one side of the base 260. A filter (not shown) for filtering impurities, such as dirt, contained in the introduced air, is inserted into the filter insertion hole 263. It is preferable that impurities is prevented from being attached to the surface of the heat exchanger 250 by inserting the filter between the base 260 and the heat exchanger 250. The filter insertion hole 263 may be an inlet port for the indoor air.

In addition, the second indoor unit 200 can be freely installed at the corner of the wall by making the framework of the base 260 inclined at a predetermined angle. It is apparent that the inlet port can be formed at the sides. Also, it is apparent that a locking hole or locking groove can be formed at an edge of the base 260, so that the second indoor unit 200 can be attached.

FIGS. 9 and 10 are a front view and a rear view of the front panel of the second indoor panel, respectively.

Referring to FIGS. 9 and 10, the front panel 201 according to the present invention corresponds to the front surface of the second indoor unit and can be painted with various colors. The front panel 201 can be decorated with pictures or photographs. The front panel 201 includes a transparent operation display window 211 through which the screen displayed on the state display part of the second indoor unit 200 is shown, and a transparent display window 210 through which a screen displaying the character image is shown.

Also, the front panel 201 includes: a front frame coupling rib 216 protruded at a rear upper side with a predetermined length and connected to the front frame 280; and a front frame coupling protrusion 213 protruded at a rear lower side with a predetermined length and curved and extended downwards. In detail, the front frame coupling rib 216 is inserted into a front panel fitting groove (285, in FIG. 12) formed at an upper side of the front frame 280. The front frame coupling protrusion 213 is inserted into the front panel fixing member (286, in FIG. 12) mounted on a lower side of the front frame 280. In this manner, the front panel 201 can be fitted into the front frame 280.

Further, at least one shape reinforcing member 220 is attached vertically so as to maintain the shape of the front panel 201 and make the front panel 201 tolerable to an external force. In detail, since the front panel 201 is thin, it is easily bent and susceptible to a damage due to an external impact. Accordingly, as shown, the shape reinforcing member (refer to FIG. 9) is additionally attached. The shape reinforcing member 220 will be described later.

In order to insert the side of the shape reinforcing member 220 into a rear side of the front panel 201, at least one shape reinforcing member insertion rib 217 is formed along the side of the shape reinforcing member 220. In detail, the insertion rib 217 is formed at a height corresponding to a thickness of the shape reinforcing member 220. Also, the insertion rib 217 is bent horizontally from an upper end and with a predetermined length, thereby fixing an upper surface of the shape reinforcing member 220.

In addition, a shape reinforcing member guide rib 215 is formed at an opposite side to the insertion rib 217 and with the same length as the shape reinforcing member 220 so as to support the side of the shape reinforcing member 220.

Further, at least one shape reinforcing member coupling boss 216 is formed between the insertion rib 217 and the guide rib 215 so as to insert a coupling member connected to the shape reinforcing member 220. The coupling boss 216 is formed on a line of a shape reinforcing support rib 218 and with the same interval. The shape reinforcing support rib 218 is formed with the same height as the central portion of the shape reinforcing member 220. In detail, the support rib 218 functions to support the central portion of the shape reinforcing member 220.

Further, a display receiving surface 214 for receiving a state display part and a display part, which will be described later, is formed at a lower side of the front panel 201. Transparent windows 210 and 211 are formed to allow the user to view the screen displayed on the display part.

FIG. 11 is a perspective view of a shape reinforcing member of the second indoor unit according to the present invention.

Referring to FIG. 11, the shape reinforcing member 220 according to the present invention is mounted to prevent the front panel 201 from being bent or to protect the front panel 201 from an external impact. Therefore, preferably, the shape reinforcing member 220 is made of metal or plastics maintaining a predetermined strength. Also, the shape reinforcing member 220 is raised in its center to a predetermined height and has on both ends a fitting part 222 bent horizontally, so that it may be stuck on the rear side of the front panel 201. A vertical cross section of the shape reinforcing member 220 is of a vertical step structure on its center as shown in the drawing, whereby the front panel 201 can endure impact applied from the outside.

Also, the fitting part 222 is fit in the shape reinforcing member insertion rib 217 formed on the rear side of the front panel 201. Also, at least one coupling member penetrating groove 221 for receiving a coupling member inserted into the shape reinforcing member coupling boss 216 is formed at the position that corresponds to the shape reinforcing member coupling boss 216 on the center of the shape reinforcing member 220.

FIG. 12 is a front perspective view of the front frame 280 according to the present invention. Referring to FIG. 12, the front frame 280 into which the front panel 201 (shown in FIG. 6, but not shown in FIG. 12) of the present invention is fitted has in its periphery a front panel fitting groove 285 for receiving the front frame coupling rib 212 formed on the upper side of the front panel 201.

Also, the front panel fixing member 286 for receiving the front frame coupling protrusion 213 formed on the lower end of the front panel 201 is formed on the lower end of the front frame. More specifically, the front panel fixing member 286 is inserted into the coupling boss 287 formed protruded on the front frame 280. Also, both sides of the front panel fixing member 286 are supported and fixed by a supporting rib 288 extended horizontally on the lower side of the front frame.

Also, a state display part 300 for displaying an operational state of the second indoor unit 200 (shown in FIGS. 6 and 7, but not shown in FIG. 12) is settled on the lower side of the front frame 280, and a display part 350 for displaying a character image so that an operational state of the second indoor unit 200 may be easily recognized by a user is settled on the upper part of the state display part 300. Also, the state display part 300 is settled on a state display part mounting boss 230 formed on the front frame 280 and joined by a coupling member, and both sides of the state display part 300 are supported by a state display supporting rib 231. Also, a groove instead of the state display part mounting boss 230 may be formed so that a coupling member may be inserted. Also, the display part 350 may be mounted on the front frame 280 in the same manner as the state display part 300 is mounted.

FIG. 13 is a front view of the state display part according to the present invention and FIG. 14 is a perspective view showing an upper case of the state display part.

Referring to FIGS. 13 and 14, the state display part of the present invention is protected by a lower case 310 and an upper case 320. Also, a PCB (Printed Circuit Board) (not shown) on which an electric circuit of the state display part is formed is settled in the inside of the lower case 310. Also, an LCD (Liquid Crystal Display) window 330 for displaying an operational state of the second indoor unit is settled on the upper side of the PCB 320. Also, the PCB and the LCD window 330 are mutually connected, so that a signal and information provided from the PCB 320 is transferred to the LCD window 330 and a user can visually check an operational state.

Also, an operation button 321 by which a user can manually operate and a receiving part 322 through which a user can control the operational state using a remote controller are formed on the lower side of the PCB.

Also, the lower case 310 has a wire settling part 312 at the lower side of the PCB, and a wire 340 connected from the PCB is put in the inside of the wire settling part 312. Also, a wire passing groove 314 through which the wire 340 passes is formed on the lateral side of the wire settling part 312.

Also, a coupling part 311 extended with a predetermined length and a coupling groove 311 penetrated on a predetermined position of the coupling part are provided on the upper side and/or the lower side of the lower case 310. More specifically, a coupling member is inserted in a passing-through manner into the coupling groove 311 and the state display part mounting boss 230 formed on the front frame 280. Also, at least one hook 313 for joining to the upper case 320 are formed on the outer periphery of the lower case 310.

Also, at least one hook insertion hole 331 for inserting into the upper side of the lower case 310 and receiving the hook 313 on the outer periphery is formed on the upper case 320. Also, an LCD window settling hole 332 to which the LCD window 330 is fit is provided to the central part.

In the meantime, the LCD window 330 displays the operational state of the second indoor unit 200, and more specifically, displays an amount of cool air discharged from the second indoor unit 200, an indoor temperature and humidity, and an operation time. Also, the state display part 300 receives a radio wave sent through a remote controller by a user, to display relevant information on the LCD window 330 in a digital manner, depending on the changing operational state. More specifically, the displaying manner may be realized by a number and may also by realized by an equalizer manner.

FIG. 15 is a view showing an operation of the display part according to the present invention. Referring to FIG. 15, the display part 350 of the present invention outputs a character image desired by a user or stored in advance in a storage medium of the apparatus. The display part 350 formed on the second indoor unit 200 may output an image realized in the same operation manner as the character image displayed on the display part 160.

More specifically, the display part 350 may include: a case 351; a PCB 352 settled on the inside of the case 351; an LCD window 353 settled on the upper part of the PCB 352; an operation button 355 formed on the lower end of the PCB 352 so that not only a user may manually operate the display part 350 and but also the operational state of the second indoor unit 200 may be automatically run depending on a set environment; and a wireless receiving part 357 for receiving an operation signal transmitted through a remote controller 710 by a user and receiving an AVATA-transmitting signal sent through a mobile means 700 such as a cellular phone by a user. Also, a selection button 356 for setting or selecting a plurality of kinds of AVATAs, is additionally provided. Also, the display part 350 is connected with a data inputting apparatus 720 as exemplified by a computer, so that various kinds of characters can be downloaded through the Internet.

Also, the display part 350 can be programmed in such a way that a current operational state of the indoor unit and a temperature may be announced in a voice at the same time a character may be displayed on the LCD window 353. Also, the voice is configured to guide the operational state of the second indoor unit 200 in a human voice through a speaker 730 connected with the controller.

Also, a memory chip 354 of a predetermined capacity, capable of receiving and storing the AVATA character sent by a user, may be built in the PCB 352. More specifically, various kinds of character images existing in form of an electronic file may be downloaded through the data inputting apparatus 720 connected with the controlling part of the air conditioner or the display part 350, and may be stored in the memory chip 354.

Also, the character downloaded through the mobile means 700 such as a cellular phone by a user, may be received in a radio way by the receiving part 357 and stored in the memory chip 354. Further, a user may produce, in person, a character image of a proper shape using the data inputting apparatus 720 and store the same in the memory chip 354. As a result, for a means by which a user can input/store/select a character, more than one among a selection button 356 of an air conditioner itself, a remote controller 710, a data inputting apparatus 720, a mobile means 700, can be selectively used.

Also, in case the second indoor unit 200 is connected and controlled as described above by the data inputting apparatus 720 and/or the mobile means 700, the operational state of the air conditioner can be controlled from a remotely located area. Therefore, a user can control the air conditioner system including the second indoor unit 200 to operate through the Internet while a user is out, and control the operation of the second indoor unit 200 using a wireless telephone. Also, a user can use the display part 350 for an Internet screen as well as a means for showing the operational state of the second indoor unit 200, by connecting the display part 350 with the Internet. In other words, the Internet screen is displayed by pressing the selection button 356 of the display part 350, so that the display part 350 can be used as a means for watching a news.

In the meantime, as described above, it will be obvious to those skilled in the art that the apparatus for controlling the operational state of the second indoor unit 200 through the Internet and the wireless communication-means, can be mounted on the state display part 300. Also, it will be apparent from the spirit of the present invention that the joining manner of the state display part 300 can be applied, in the same way, to the manner in which the display part 350 is settled on the case and joined to the front frame 280.

The operational state of the display part will now be described in the following.

On the first place, if a user transmits an operation signal by pressing, in person, the operation button 355 or through the remote controller 710 and the receiving part 357 receives the operation signal, the second indoor unit 200 operates. Also, the moment the second indoor unit 200 operates, a power source is applied to the display part 350 and a specific character image stored in advance or input by a user, is displayed. For example, it is possible to have a character that have been sleeping wakes up. Also, simultaneously, it is possible to inform the operation of the second indoor unit 200 with a voice through the speaker 730 connected with the display part 350. Also, the voice may be downloaded through the mobile means 700 or the data inputting apparatus 720, or recorded and stored in the memory chip 354 by a user in person.

Also, while an amount of air, an indoor temperature, humidity, an operation time are displayed on the state display part 300, the character may perform a proper gesture depending on an amount of air, an indoor temperature, humidity, or a voice informing such information may be announced through the speaker 730. For example, a user can set in such a way that if a present temperature is below the proper temperature programmed in advance, the character may perform a gesture shivering with cold, and simultaneously, a guiding message informing that the indoor temperature is too low may be announced through the speaker. Also, if the second indoor unit 200 is turned off, the character may perform a gesture falling asleep and a guiding message informing that the operation of the second indoor unit 200 is stopped may be announced through the speaker 730.

Also, a user may arbitrarily select the kind of the AVATA using the selection button 356.

FIG. 16 is a block diagram explaining a control state of the air conditioner according to the present invention.

Referring to FIG. 16, there are provided a key inputting part 31 with which a control state of the air conditioner is operated by a user; a power source part 32 for applying a power source to the air conditioner; an data inputting apparatus 33 for inputting a specific character and a plurality of character images using the character, to the air conditioner; a controlling part 30 where a control state of the air conditioner is stored in a storing medium formed in the inside of the air conditioner and for controlling the operation of the air conditioner using the input information; an operational state display part 34 on which at least character image is displayed under the control of the controlling part 30; a voice outputting part 35 for outputting the operational state of the air conditioner in a voice under the control of the controlling part 30; a fan operating part 36 for controlling the operational state of the outdoor unit and/or the indoor unit, under the control of the controlling part 30; and a compressor operating part 37 for circulating a coolant.

More specifically, the key inputting part 31, which is a part with which a user operates the operational state of the air conditioner, may be at least one selected among a remote controller of the air conditioner, a button formed on the appearance of the apparatus, a computer system connected through wiring/wireless network. Also, the data inputting part 33 is a device for generating or downloading a character and a plurality of character images where the specific character appears and transferring the same to the controlling part 30. For such a data inputting part 33, at least one among a computer, a mobile means, a remote controller, may be used.

Also, the operational state display part 34 formed on the air conditioner, preferably, a predetermined outer side of the indoor unit, is a part through which the operational state of the air conditioner may be displayed to a user in an easy and simple manner with the character image displayed. Preferably, the operational state display part 34 is realized by the LCD so that a user may recognize the character image in a convenient and beautiful manner.

By displaying, as described above, the character image on the operational state display part 34, a user can recognize the operational state of the air conditioner in a more easy and convenient manner. Particularly, since a shape of the character image changes depending on the operational state of the air conditioner, a user can recognize the operational state of the air conditioner in even more easy and convenient manner.

Also, the voice outputting part 35, which is a part for outputting the operational state of the air conditioner in form of a voice, can output the operational state of the air conditioner in form of a voice depending on a user's desire.

Also, the fan operating part 36 and the compressor operating part 37, which are apparatuses for circulating a coolant in the inside of the cooling cycle to get a coolant to pass through processes of compression, condensation, expansion, and evaporation in accordance with the operational state by a user, are on/off-controlled by the controlling part 30 depending on the operational state and the indoor temperature of the air conditioner.

The operation of the air conditioner will be briefly described with reference to the block diagram of the described air conditioner system. The air conditioner system of the present invention can be operated in three modes. A first mode is a character image uploading mode for uploading a character image into the controlling part 30 in the inside of the air conditioner using the data inputting part 33. A second mode is a character image display mode where the air conditioner system is operated by operation of the key inputting part 31 by a user and the character image is displayed on the operational state display part 34. A third mode is a character and a character image selecting mode for selecting a set of character images related to a specific character.

As described above, by making the kind of the character image changed depending on the operational state of the air conditioner, the recognition of a user can be convenient even more. Also, since a specific character is selected in accordance with a taste of a user and a specific set of character images can be selected among a plurality of character images where the character is used, a user can display a character fit for a user's taste, on the air conditioner in a convenient manner. For an extreme example, a user's picture may be displayed.

In the meantime, the character and the character image selecting mode is easily performed by cooperative operation of the key inputting part 31 and the controlling part 30. More specifically, after the process for selecting a character is performed, a specific character image is selected among a plurality of character images related to the selected character, for each operational state of the air conditioner. Of course, if a user desires, a specific character needs not to be used in a related set, for each operational state of the air conditioner, and other character image where other character is used, may be set for each operational state of the air conditioner.

Therefore, the character image uploading mode and the character image display mode will be described in detail in the following.

FIG. 17 is a flowchart explaining the character image uploading mode according to the spirit of the present invention.

Referring to FIG. 17, a user obtains a character and/or a character image by downloading through a network or by producing, in person, the character image (S11). For the process in which the character is generated, any type of method such as wiring/wireless network and a producing by a user, may be used without limitations. Of course, when the air conditioner is brought to the market, a plurality of characters, a plurality of character images where a pose, a background, a position, and a movement are different for each character, may be stored in a set in the storing medium in the inside of the controlling part 30.

Afterwards, a user uploads the generated character image to the controlling part 30 through the data inputting part 33 (S12). The uploading process can be easily performed through a LAN (Local Area Network) and wiring/wireless Internet. The character and the character image uploaded in this manner, are stored in the storing medium of the controlling part 30 (S13), and upon calling by a user, one set of character images to which a specific character is applied, is called and used in the air conditioner.

FIG. 18 is a flowchart explaining the character image display mode of the air conditioner to which the spirit of the present invention is applied.

Referring to FIG. 18, the operation of the air conditioner is started by an input or reservation setting of a user (S21). If the operation of the air conditioner is started, one set of character images selected in advance by a user is called and a character image appropriate for a present state, initial operation of the air conditioner, is displayed on the operational state display part 34 on the first place (S22). If a selected character is absent at the present point of time, selection of a character may be automatically requested on the first place, or one set of character images designated from the time of manufacturing of the air conditioner, may be called.

Afterwards, it is judged whether the operational state of the air conditioner is changed while the operation of the air conditioner is continuously performed (S23). If the operational state of the air conditioner is changed, a new character image appropriated for the changed operational state of the air conditioner among the called one set of character images, is automatically displayed in accordance with the changed operational state of the air conditioner (S24). If the operational state of the air conditioner is not changed, the character image of the present state is continuously displayed.

If the operation of the air conditioner is ended while the new changed character image is displayed, a character image of ended state is displayed (S26) and the operation of the air conditioner is ended. However, if the operation of the air conditioner is not ended, the process is moved to the step of judging a change of the operational state of the air conditioner (S23), and the process for changing the character image is repeated until the air conditioner is ended.

In case a user sets a specific character image in advance, for each operational state of the air conditioner, in performing the character image display mode as described above, not only the character image included in one set related to a single character but also another character image where another character is used, may be displayed for each operational state of the air conditioner in accordance with a taste of a user.

With a Whini, character that will be set in advance in the storing medium of the product, taken as an example, changing of the character image according to the gesture, the pose, the position, and the background will be described in the following.

FIG. 19 shows a character image displayed in the start/stop mode of the operation of the air conditioner.

Referring to FIG. 19, upon starting of the operation, the character image moving from the lower side to the upper side is displayed. On the contrary, upon ending of the operation, the character image moving from the character image on the upper side to the character image on the lower side, is displayed on the operational state display part 34.

FIG. 20 shows a character image displayed in the cooling operation mode of the air conditioner. Referring to FIG. 20, upon the general cooling operation, the character image on the upper side is displayed and upon a power cooling operation, the character image on the lower side is displayed.

FIG. 21 shows a character image displayed in the dehumidifying operation mode of the air conditioner. Referring to FIG. 21, upon the dehumidifying operation mode, the character images on the upper side and on the lower side are alternately displayed.

FIG. 22 shows a character image displayed in the artificial intelligence operation mode of the air conditioner. Referring to FIG. 22, upon the artificial intelligence operation mode, the character images on the upper side and on the lower side are alternately displayed.

FIG. 23 shows a character image displayed in the plasma clean operation mode of the air conditioner. Referring to FIG. 23, upon the plasma clean operation mode, the character images on the upper side and on the lower side are alternately displayed.

As shown in the character images exemplified by FIGS. 19 to 23, even under the state that the same character appears as a major character, the character image displayed on the operational state display part 34 is varied in detail in accordance with the change of the operational state of the air conditioner. Since the displayed character is changed in this manner, a user can check the operational state of the air conditioner in a more easy manner. Also, by the display parts 160 and 350 formed on the front of the air conditioner, the air conditioner can be quality-enhanced and a taste of a user can be satisfied even more.

Further, in case the character and the character image are set differently for each operational state of the air conditioner according to a taste of a user, there is a strong point that even the same air conditioner can be used for a long time as if it were a new apparatus.

SECOND EMBODIMENT

The second embodiment of the present invention is the same in most part as the first embodiment. Only difference is that the display parts 160 and 350 on which at least a character image is displayed and the state display parts 170 and 300 on which the operational state of the air conditioner is displayed with a number or an arrow, are not formed separately but one or both two are displayed on a single LCD window by a selection of a user.

More specifically, in the first embodiment, the display parts 160 and 350, and the state display parts 170 and 300 are separately formed on both the first indoor unit 100 and the second indoor unit 200. However, in that case, since the wide area on the front side of the indoor unit is occupied, it is not preferable in viewpoints of costs and use. Therefore, there is provided a method where a state that a character image is selectively displayed on a single display part by a selection of a user (for example, the display part of the first embodiment), or a state that the operational state of the air conditioner is displayed with letters (for example, the state display part of the first embodiment), are selectively displayed or both state are all displayed with use of the characteristics of the LCD where various screen configurations are possible.

FIGS. 24 and 25 show the operational state of the display part. FIG. 24 shows that the character image is displayed on the display part and FIG. 25 shows the operational state of the air conditioner is displayed on the display part.

Referring to FIGS. 24 and 25, there are provided a front panel 810 formed on a front of the air conditioner; a side panel 820 formed on the side of the air conditioner; a display window 860 formed on the front panel 810; an operation button 880 formed on one side of the display window 860, for operating the operational state of the air conditioner; a selection button 871 formed on the other side of the display window 860, for switching a screen displayed on the display window 860, into a display part where a character image is displayed or a state display part where the operational state of the air conditioner is displayed with letters; and a character setting button 872 for selecting the kind of a character or the kind of a character image. Also, for the display window 860, the LCD is preferably used as the first embodiment.

For other parts of the present embodiment, the descriptions made for the first embodiment are quoted. Particularly, the selection button 871 will be described in detail. By a number of times the selection button 871 is pressed, the display window 860 operates as the display part 861 where the character image is displayed (refer to FIG. 24) or operates as the state display part 862 where the operational state of the air conditioner is displayed with letters (refer to FIG. 25). Of course, it will be easily estimated that both the display part 861 and the state display part 862 can be all displayed.

Also, it is possible to have a specific kind of characters and a specific kind of character images selected if the character setting button 872 is pressed. Also, in case a plurality of character setting buttons 872 is provided, a button for selecting a character and a button for selecting a character image can be separately provided, for each kind of buttons. Particularly, though not described in the first embodiment, the character setting button 872 will be easily realized also in the first embodiment. Also, if the character setting button 872 is not provided, the kind of the character and the kind of the character image may be easily selected together with the gesture input from the data inputting part 33.

MODE FOR INVENTION

The present invention is characterized in that a predetermined display window is realized on the front of the air conditioner and a character image in which a predetermined character image is used, is displayed on the display window. Also, the present invention is characterized in that a user can use the air conditioner in a more convenient manner thanks to the character and the character image related to the character.

Within the range satisfying the above characteristics, the air conditioner capable of improving the user's recognizability according to the present invention, can have various form in its embodiments.

On the first place, in case two indoor units are not used but a single indoor unit is used in a single outdoor unit, an effect that a user's convenience is improved can be obtained by realizing, on the single indoor unit, a display window on which a character and/or a character image is displayed.

Also, the spirit of the present invention can be applied not only to the air conditioner that has been described by the detailed embodiment, but also to other electronic appliances such as a cooking apparatus and a refrigerator, with change in its form in a convenient manner. At this time, with the character maintained as it is, the operational state of the air conditioner can be displayed by changing a pose, a position, a background, and a behavior of the character.

Also, even though the apparatus and/or method for inputting, selecting, or setting a character and a character image may be changed depending on detail use conditions, such changes will not influence on realization of the spirit of the present invention.

Also, for the character image displayed on the display part, not only the character image where the character is used, but also a character of a representative shape may be constantly displayed regardless of the operational state of the air conditioner. In case of the air conditioner, it will be preferable that a character that can emphasize coolness such as a penguin is selected.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the spirit of the present invention, a character image understandable as the relevant operational state depending on the operational state of the air conditioner, is displayed on one side of the air conditioner, so that a user can understand the operational state of the air conditioner in a convenient manner, without looking at the state display part displayed with letters.

Also, the present invention uses a character of a beautiful design besides the state display part displayed with letters of the conventional stiff image, thereby possibly obtaining more better visual effect. Accordingly, a user's taste can be promoted even more.

Also, according to the present invention, a user can produce, in person, a character desired by a user, obtain various characters and character images where the character is used through various communication media, store in the storing medium in the inside of the air conditioner, and use the same. Therefore, since a user who makes use of the air conditioner can newly display a new character and/or a new character image at any time when a user desires or is tired of the existing character, the present invention has an effect that a user can use the air conditioner for a more longer time and a user can view the air conditioner as if it were a newly purchased apparatus at any time when a user desires.

Also, the present invention additionally includes a voice outputting part for displaying the operation of the air conditioner, so that a voice message is properly output for each operational state of the air conditioner. Therefore, there is a strong point that a remotely located user or even the blind can use the air conditioner in a more convenient manner.

Also, in case the same character is used for the entire items of the electronic appliances manufactured by a single company, the character as a trademark can enhance a brand image of the manufacturing company and in case the character is used for an advertising means, the character can function as a means for obtaining advertisement profit.

The invention claimed is:

1. An air conditioner having an enhanced user perception, comprising:

a panel forming an appearance of either side of the air conditioner;

a display part formed on the panel displaying an avatar comprising character images of a character in various appearances depending on an operational state of the air conditioner;

a controller disposed inside the air conditioner and connected to the display part, the controller directly controlling the display part displaying the avatar changing from one of the character images with one of the various appearances to another one of the character images with another one of the various appearances when the controller changes the operational state of the air conditioner; and a state display part formed on panel displaying the operational state of the air conditioner as a symbol.

2. The air conditioner of claim 1, further comprising a speaker for displaying an operational state of the air conditioner as sound and/or voice.

3. The air conditioner of claim 1, wherein the character images are varied by a user's choice.

4. The air conditioner of claim 1, wherein the character images are transmitted from an external device and is stored in the air conditioner.

5. The air conditioner of claim 1, wherein the character images are downloaded from a network and is stored in the air conditioner.

6. The air conditioner of claim 1, wherein the display part is an LCD.

7. The air conditioner of claim 1, wherein the panel is a front panel formed at a front side of the air conditioner.

8. An air conditioner having an enhanced user perception, comprising:

a key input part manipulated by a user to control an operation of the air conditioner;

an operational state display part at least displaying an avatar comprising character images of a character in various appearances adapted for an operational state of the air conditioner;

a state display part displaying the operational state of the air conditioner as a symbol; and a controller connected to the key input part and judging a signal transmitted from the key input part to control the operational state of the air conditioner, the controller being disposed inside the air conditioner and connected to the operational state display part, the controller directly controlling the operational state display part displaying the avatar changing from one of the character images with one of the various appearances to another one of the character images with another one of the various appearances when the controller changes the operational state of the air conditioner.

9. The air conditioner of claim 8, further comprising a data input part for inputting the character images to the control part.

10. The air conditioner of claim 9, wherein the data input part is at least one selected from the group consisting of a computer connected by a network, a mobile means connected by a wireless network, and a remote controller.

11. The air conditioner of claim 8, wherein the key input part comprises a character set button for selecting the character images of one of a plurality of characters.

12. The air conditioner of claim 8, wherein the operational state display part is installed in an indoor unit of an air conditioner system.

13. The air conditioner of claim 8, wherein the key input part is a plurality of buttons formed on an outer surface of the air conditioner or a remote controller.

14. The air conditioner of claim 8, wherein the character images are uploaded from an external device to the air conditioner.

15. The air conditioner of claim 8, wherein the character images are manufactured by a user of the air conditioner.

16. The air conditioner of claim 14, wherein the character images are uploaded to the air conditioner by a wiring communication or a wireless communication.

17. The air conditioner of claim 8, wherein the character images are designated depending on an operational state of the air conditioner.

18. The air conditioner of claim 8, wherein the character images are displayed even at the time of operation start and completion of the air conditioner.

19. The air conditioner of claim 8, wherein the character images are varied depending on an operational state of the air conditioner.

20. The air conditioner of claim 8, wherein when the operational state of the air conditioner is changed, only a background of the character image is changed without any change of appearance of the character.

21. The air conditioner of claim 8, wherein when an operation of the air conditioner starts and the character is not designated by a user, a designation is requested or one of the character images of a character predesignated in manufacture is displayed.

22. The air conditioner of claim 1, wherein the character images of the character in various appearances are different from each other on a background of the character images so as to indicate different operational states of the air conditioner.

23. The air conditioner of claim 8, wherein the character images of the character in various appearances are different from each other on a background of the character images so as to indicate different operational states of the air conditioner.

* * * * *